US008622140B2

(12) United States Patent
Falk et al.

(10) Patent No.: US 8,622,140 B2
(45) Date of Patent: Jan. 7, 2014

(54) JET PUMP AND MULTI-STRING TUBING SYSTEM FOR A FLUID PRODUCTION SYSTEM AND METHOD

(75) Inventors: Kelvin Falk, Calgary (CA); Collin R. Morris, Loydminster (CA); Erik Reissig, Conroe, TX (US)

(73) Assignee: 1497690 Alberta Inc., Calgary (CA)

( * ) Notice: Subject to any disclaimer, the term of this patent is extended or adjusted under 35 U.S.C. 154(b) by 128 days.

(21) Appl. No.: 12/788,104

(22) Filed: May 26, 2010

(65) Prior Publication Data

US 2011/0067883 A1 Mar. 24, 2011

Related U.S. Application Data

(60) Provisional application No. 61/181,209, filed on May 26, 2009.

(51) Int. Cl.
*E21B 43/00* (2006.01)

(52) U.S. Cl.
USPC ..... 166/372; 166/369; 166/105; 417/151

(58) Field of Classification Search
USPC ..... 166/369, 311, 372, 312, 105, 68; 417/181, 151, 197
See application file for complete search history.

(56) References Cited

U.S. PATENT DOCUMENTS

| | | | |
|---|---|---|---|
| 1,555,232 | A | 9/1925 | Strait |
| 1,758,376 | A | 5/1930 | Sawyer |
| 1,791,292 | A | 2/1931 | Smith |
| 1,867,876 | A | 7/1932 | Clark |
| 2,080,623 | A | 5/1937 | McMahon |
| 2,722,895 | A | 11/1955 | DePorter |
| 2,798,435 | A | 7/1957 | Armstrong |
| 4,280,662 | A | 7/1981 | Erickson et al. |
| 4,374,530 | A | 2/1983 | Walling |
| 4,441,861 | A | 4/1984 | Canalizo |

(Continued)

FOREIGN PATENT DOCUMENTS

| | | |
|---|---|---|
| CA | 1179251 | 11/1984 |
| CA | 1179251 | 12/1984 |

(Continued)

OTHER PUBLICATIONS

Chen S. et al., "An Integrated Sand Cleanout System by Employing Jet Pumps," JCPT, May 2009, vol. 48 No. 5; pp. 17-22.

(Continued)

*Primary Examiner* — Daniel P Stephenson
(74) *Attorney, Agent, or Firm* — Dentons US LLP

(57) ABSTRACT

A method to produce formation fluid from an oil or gas well. The methods employs a jet pump and a spoolable multi-string tubing system. The jet pump is adapted to produce formation fluid, which may be produced in combination with power fluid. The multi-string tubing system consists of two or more tubing conduits, allowing surface pump equipment to deliver power fluid to the jet pump down a supply tubing string, while return fluid is returned up a return tubing string. Other downhole functions can be provided with the inclusion of additional features on the jet pump and additional conduits or conductors in the multi-string tubing system. Preferred embodiments provide additional functionality by inclusion of a jetting sub, sensing elements, or a back-pressure valve to the jet pump, and auxiliary tubing strings or communication members to the spoolable multi-string tubing system.

31 Claims, 23 Drawing Sheets

(56) References Cited

U.S. PATENT DOCUMENTS

| | | | | |
|---|---|---|---|---|
| 4,658,893 | A | 4/1987 | Black | |
| 4,718,486 | A | 1/1988 | Black | |
| 4,988,389 | A | 1/1991 | Adamche | |
| 5,033,545 | A | 7/1991 | Sudol | |
| 5,055,002 | A | 10/1991 | Roeder | |
| 5,083,609 | A | 1/1992 | Coleman | |
| 5,372,190 | A | 12/1994 | Coleman | |
| 6,167,960 | B1 | 1/2001 | Moya | |
| 6,250,389 | B1 | 6/2001 | Sudol | |
| 6,330,915 | B1 | 12/2001 | Moya | |
| 6,354,371 | B1 | 3/2002 | O'Blanc | |
| 7,048,514 | B2 | 5/2006 | Khomynets | |
| 7,152,683 | B2 | 12/2006 | Khomynets | |
| 7,172,038 | B2 | 2/2007 | Terry et al. | |
| 7,222,675 | B2 * | 5/2007 | Williams | 166/372 |
| 7,255,175 | B2 | 8/2007 | Jackson et al. | |
| 7,273,108 | B2 | 9/2007 | Misselbrook | |
| 7,347,259 | B2 | 3/2008 | Ravensbergen et al. | |
| 7,516,792 | B2 | 4/2009 | Lonnes et al. | |
| 7,658,229 | B2 | 2/2010 | Becker et al. | |
| 7,909,089 | B2 | 3/2011 | Jackson | |
| 8,118,103 | B2 * | 2/2012 | Williams | 166/372 |
| 8,122,862 | B2 | 2/2012 | Hicks | |
| 2007/0020114 | A1 | 1/2007 | McFarland | |
| 2007/0187111 | A1 | 8/2007 | Misselbrook et al. | |
| 2008/0314578 | A1 | 12/2008 | Jackson | |
| 2010/0230107 | A1 * | 9/2010 | Falk et al. | 166/311 |
| 2010/0247345 | A1 | 9/2010 | Morris | |
| 2011/0067883 | A1 | 3/2011 | Falk et al. | |

FOREIGN PATENT DOCUMENTS

| | | |
|---|---|---|
| CA | 1325969 | 1/1994 |
| CA | 2438877 | 10/2002 |
| CA | 2602964 | 5/2006 |
| CA | 2602964 | 10/2006 |
| CA | 2193923 | 1/2007 |
| CA | 2635526 | 12/2008 |
| GB | 2107397 | 4/1983 |
| WO | 9429571 | 12/1994 |
| WO | WO 94/29571 | 12/1994 |
| WO | 2009049420 | 4/2009 |

OTHER PUBLICATIONS

U.S. Non-Final Office Action corresponding to U.S. Appl. No. 12/721,409 dated Jul. 23, 2012.

Chen, S. et al., "An Integrated Sand Cleanout System by Employing Jet Pumps," Journal of Canadian Petroleum Technology (JCPT), May 2009, vol. 48, No. 5, pp. 17-23.

Final Office Action mailed on Feb. 28, 2013, U.S. Appl. No. 12/721,409, 8 pages.

Advisory Action mailed on May 3, 2013, U.S. Appl. No. 12/721,409, 2 pages.

* cited by examiner

JET PUMP AND MULTI-STRING TUBING SYSTEM FOR A FLUID PRODUCTION SYSTEM AND METHOD

CROSS REFERENCE TO RELATED APPLICATIONS

This application claims the benefit of priority of U.S. Provisional Patent Application No. 61/181,209 filed May 26, 2009, which is incorporated herein by reference in its entirety.

FIELD OF THE INVENTION

The present invention relates generally to jet pumps. More particularly, the present invention relates use of jet pumps for fluid production.

BACKGROUND OF THE INVENTION

Various types of formation fluid recovery systems have been devised for moving fluid from a downhole hydrocarbon formation to the surface. Common fluid recovery systems are beam pumps, progressive cavity pumps electric submersible pumps and gas lift systems. All of the above have operational issues which can limit their performance and application. Jet pumps are useful in a wide range of well applications. Nonetheless, jetpumps for use in hydrocarbon production are a relatively underdeveloped technology.

To date, jet pump systems have been installed using either conventional jointed tubing or conventional coiled tubing. In some of these installations, the process requires that there be two strings installed in the well. Where two strings are used, they are most typically configured as a tubing string inside of a tubing string, or a concentric configuration. In most of these applications the tubing systems are not adapted for rapid deployment and retrieval.

There are operational and technical advantages to configuring the system with two or more substantially parallel tubing strings or electrical conductors. However, until recently significant practical problems with this approach had not been addressed. The present invention provides a bundled tubing system which is readily deployed and installed in a wellbore using a single conventional coiled tubing unit. Combining this system with a jet pump facilitates a broad range of applications, for example production of hydrocarbons from a hydrocarbon bearing formation.

The abstract of U.S. Pat. No. 5,033,545 reads as follows: "The device employs the jet pump principle to bring a power fluid to sedimented solids and the like plugging a conduit, and it includes at least one nozzle which directs the power fluid in a high-velocity jet against the solids to bring the solids into suspension for subsequent removal thereof using the jet pump principle."

The abstract of U.S. Pat. No. 5,372,190 reads as follows: "A down hole jet pump having various unique features which enables the pump to be used with various types of producing wells including those which produce gas along with a large ratio of water which may include considerable abrasive solid materials and can be run and retrieved inside coil tubing of relative small diameter as well as conventional threaded pipe of relatively small diameter. The embodiments of the jet pump disclosed enable the components of the jet pump to be retrieved by reversal to enable removal, replacement or adjusted to provide optimum operation of the pump in accordance with the installation requirements without the use of special tools."

Concentric completion may require that a service rig first run an outer string and then run an inner string. The inner string may be a jointed string or a string of coiled tubing. In either case a considerable amount of time is required for installing the concentric strings; equipment and operating costs can therefore be significant. Similarly, if the downhole equipment must be retrieved, concentric tubing may increase the time required for retrieval of the downhole equipment.

It is, therefore, desirable to provide a system and method for multi-string tubing jet pump system for fluid production.

SUMMARY OF THE INVENTION

It is an object of the present invention to obviate or mitigate at least one disadvantage of previous systems and methods for multi-string tubing jet pump system for fluid production.

In a first aspect, the present invention provides a method of producing formation fluid from a hydrocarbon bearing formation including:

- providing a jet pump having a jet pump intake, a venturi nozzle, a venturi gap, a diffuser, and a jetting sub;
- deploying the jet pump into a wellbore;
- supplying power fluid to the jet pump via a supply tubing string; and
- receiving return fluid from the jet pump via a return tubing string.

In a further aspect, the present invention provides a method of producing formation fluid from a hydrocarbon bearing formation including:

- providing a spoolable multi-string tubing system having two or more conduits laterally disposed with respect to one another, the two or more conduits comprising a supply tubing string and a return tubing string;
- providing a jet pump having a power fluid inlet; a jet pump intake, a venturi nozzle, a venturi gap, and a diffuser in fluid communication with the power fluid inlet; a return tube in fluid communication with the diffuser; and a return fluid outlet in fluid communication with the return tube; wherein the power fluid inlet and the return fluid outlet are laterally disposed with respect to one another to facilitate connection of the power fluid inlet to the supply tubing string and of the return fluid outlet to the return tubing string;
- establishing fluid communication between the two or more conduits and the jet pump at the power fluid inlet and the return fluid outlet;
- deploying the jet pump into a wellbore;
- supplying power fluid to the jet pump via a supply tubing string; and
- receiving return fluid from the jet pump via a return tubing string.

In an embodiment, the present invention provides a method of producing formation fluid from a hydrocarbon bearing formation wherein the jet pump further includes a jetting sub, and further including flowing jetting fluid out of the jetting sub.

In an embodiment, the present invention provides a method of producing formation fluid from a hydrocarbon bearing formation wherein the jet pump further includes a jetting sub, and further including flowing jetting fluid out of the jetting sub continuously and simultaneously with supplying power fluid to the jet pump and receiving return fluid from the jet pump.

In an embodiment, the present invention provides a method of producing formation fluid from a hydrocarbon bearing formation wherein the jet pump further includes a jetting sub, and further including flowing jetting fluid out of the jetting sub intermittently and simultaneously with supplying power fluid to the jet pump and receiving return fluid from the jet pump.

In an embodiment, the present invention provides a method of producing formation fluid from a hydrocarbon bearing formation wherein the jet pump further includes a jetting sub, and further including:

ceasing to receive return fluid from the jet pump;

flowing jetting fluid out of the jetting sub;

ceasing to flow jetting fluid out of the jetting sub; and receiving return fluid from the jet pump via the return tubing string.

In an embodiment, the present invention provides a method of producing formation fluid from a hydrocarbon bearing formation wherein the jet pump further includes a jetting sub, wherein the spoolable multi-string tubing system further includes an auxiliary tubing string, and further including:

establishing fluid communication between the jet pump and the auxiliary tubing string;

supplying jetting fluid to the jetting sub via the auxiliary tubing string; and flowing jetting fluid out of the jetting sub.

In an embodiment, the present invention provides a method of producing formation fluid from a hydrocarbon bearing formation wherein the jet pump further includes a jetting sub, wherein the spoolable multi-string tubing system further includes an auxiliary tubing string, and further including:

establishing fluid communication between the jet pump and the auxiliary tubing string;

ceasing to supply power fluid to the jet pump;

ceasing to receive return fluid from the jet pump;

supplying jetting fluid to the jetting sub via the auxiliary tubing string;

flowing jetting fluid out of the jetting sub;

ceasing to flow jetting fluid out of the jetting sub;

supplying power fluid to the jet pump; and receiving return fluid from the jet pump.

In an embodiment, the present invention provides a method of producing formation fluid from a hydrocarbon bearing formation wherein the jet pump further includes a data-sensing sub, wherein the spoolable multi-string tubing system further includes a communications line, and further including:

operatively connecting the data-sensing sub and the communications line;

sensing data with the data-sensing sub; and receiving the data at the surface via the communications line.

In an embodiment, the present invention provides a method of producing formation fluid from a hydrocarbon bearing formation wherein the wherein the venturi nozzle, venturi gap, and diffuser are located on a carrier sub, and further including:

ceasing to supply power fluid to the jet pump;

ceasing to receive return fluid from the jet pump; and supplying power fluid to the jet pump via the return tubing string to unseat the carrier sub and convey it to the surface via the supply tubing string.

In an embodiment, the present invention provides a method of producing formation fluid from a hydrocarbon bearing formation wherein the wherein the venturi nozzle, venturi gap, and diffuser are located on a carrier sub, and further including:

ceasing to supply power fluid to the jet pump;

ceasing to receive return fluid from the jet pump;

supplying power fluid to the jet pump via the return tubing string to unseat the carrier sub and convey it to the surface via the supply tubing string; and supplying power fluid to the jet pump via the supply tubing string to convey the carrier sub to the jet pump and seat the carrier sub in the jet pump.

In an embodiment, the venturi nozzle and diffuser are substantially parallel with the return tube.

In a further aspect, the present invention provides a method of producing formation fluids from a hydrocarbon bearing formation including:

providing a jet pump having a jet pump intake, a venturi nozzle, a venturi gap, and a diffuser;

providing a permanent spoolable multi-string tubing system having two or more conduits in fluid communication with the jet pump, the two or more conduits comprising a permanent supply tubing string and a permanent return tubing string;

providing a production spoolable multi-string tubing system having two or more conduits in fluid communication with the jet pump and with the permanent spoolable multi-string tubing system, the two or more conduits comprising a production supply tubing string and a production return tubing string;

deploying the jet pump into a wellbore;

supplying power fluid to the jet pump via the production supply tubing string and permanent supply tubing string; and receiving return fluid from the jet pump via the production return tubing string and permanent return tubing string.

In an embodiment, the present invention provides a method of producing formation fluids from a hydrocarbon bearing formation further including:

providing a cleanout spoolable multi-string tubing system having two or more conduits, the two or more conduits comprising a cleanout supply tubing string and a cleanout return tubing string;

ceasing to supply power fluid to the jet pump;

ceasing to receive return fluid from the jet pump;

disconnecting the production spoolable multi-string tubing system from the permanent spoolable multi-string tubing system;

establishing fluid communication between the two or more conduits of the cleanout spoolable multi-string tubing system and the two or more conduits of the permanent spoolable multi-string tubing system;

supplying power fluid to the jet pump via the cleanout supply tubing string and permanent supply tubing string; and receiving return fluid from the jet pump via the cleanout return tubing string and permanent return tubing string.

In an embodiment, the present invention provides a method of producing formation fluids from a hydrocarbon bearing formation wherein the jet pump further includes a jetting sub, and further including flowing jetting fluid out of the jetting sub.

In an embodiment, the present invention provides a method of producing formation fluid from a hydrocarbon bearing formation wherein the jet pump further includes a jetting sub, and further including flowing jetting fluid out of the jetting sub continuously and simultaneously with supplying power fluid to the jet pump and receiving return fluid from the jet pump.

In an embodiment, the present invention provides a method of producing formation fluid from a hydrocarbon bearing formation wherein the jet pump further includes a jetting sub, and further including flowing jetting fluid out of the jetting sub intermittently and simultaneously with supplying power fluid to the jet pump and receiving return fluid from the jet pump.

In an embodiment, the present invention provides a method of producing formation fluids from a hydrocarbon bearing formation wherein the jet pump further includes a jetting sub, and further including:

ceasing to receive return fluid from the jet pump;

flowing jetting fluid out of the jetting sub;

ceasing to flow jetting fluid out of the jetting sub; and receiving return fluid from the jet pump via the permanent return tubing string and production return tubing string.

In an embodiment, the present invention provides a method of producing formation fluid from a hydrocarbon bearing formation wherein the jet pump further includes a jetting sub, wherein the permanent spoolable multi-string tubing system further includes a permanent auxiliary tubing string, wherein the production spoolable multi-string tubing system further includes a production auxiliary tubing string, and further including:

establishing fluid communication between the jet pump and the permanent auxiliary tubing string;

establishing fluid communication between the permanent auxiliary tubing string and the production tubing string;

supplying jetting fluid to the jetting sub via the production auxiliary tubing string and the permanent auxiliary tubing string; and flowing jetting fluid out of the jetting sub.

In an embodiment, the present invention provides a method of producing formation fluid from a hydrocarbon bearing formation wherein the permanent spoolable multi-string tubing system further includes a permanent auxiliary tubing string, wherein the production spoolable multi-string tubing system further includes a production auxiliary tubing string, and further including:

establishing fluid communication between the jet pump and the permanent auxiliary tubing string;

establishing fluid communication between the permanent auxiliary tubing string and the production tubing string;

ceasing to supply power fluid to the jet pump;

ceasing to receive return fluid from the jet pump;

supplying jetting fluid to the jetting sub via the production auxiliary tubing string and the permanent auxiliary tubing string;

flowing jetting fluid out of the jetting sub;

ceasing to flow jetting fluid out of the jetting sub;

supplying power fluid to the jet pump; and receiving return fluid from the jet pump.

In an embodiment, the present invention provides a method of producing formation fluid from a hydrocarbon bearing formation wherein the jet pump further includes a data-sensing sub, wherein the permanent spoolable multi-string tubing system further includes a permanent communications line, wherein the production spoolable multi-string tubing system further includes a production communications line, and further including:

operatively connecting the data-sensing sub and the permanent communications line;

operatively connecting the permanent communications line and the production communications line;

sensing data with the data-sensing sub; and receiving the data at the surface via the communications line.

In an embodiment, the present invention provides a method of producing formation fluid from a hydrocarbon bearing formation wherein the wherein the venturi nozzle, venturi gap, and diffuser are located on a carrier sub, and further including:

ceasing to supply power fluid to the jet pump;

ceasing to receive return fluid from the jet pump; and supplying power fluid to the jet pump via the production return tubing string and permanent return tubing string to unseat the carrier sub and convey it to the surface via the supply tubing string.

In an embodiment, the present invention provides a method of producing formation fluid from a hydrocarbon bearing formation wherein the wherein the venturi nozzle, venturi gap, and diffuser are located on a carrier sub, and further including:

ceasing to supply power fluid to the jet pump;

ceasing to receive return fluid from the jet pump;

supplying power fluid to the jet pump via the production return tubing string and permanent return tubing string to unseat the carrier sub and convey it to the surface via the supply tubing string; and supplying power fluid to the jet pump via the production supply tubing string and permanent supply tubing string to convey the carrier sub to the jet pump and seat the carrier sub in the jet pump.

In a further aspect, the present invention provides a method of producing formation fluid from a hydrocarbon bearing formation including:

providing a spoolable multi-string tubing system having two or more conduits and an auxiliary tubing string, the two or more conduits comprising a supply tubing string and a return tubing string;

providing a jet pump having a jet pump intake, a venturi nozzle, a venturi gap, a diffuser, and a jetting sub;

establishing fluid communication between the two or more conduits and the jet pump, and between the auxiliary tubing string and the jet pump;

deploying the jet pump into a wellbore;

supplying power fluid to the jet pump via the supply tubing string;

receiving return fluid from the jet pump via the return tubing string;

supplying jetting fluid to the jetting sub via the auxiliary tubing string; and flowing jetting fluid out of the jetting sub.

In a further aspect, the present invention provides a method of producing formation fluid from a hydrocarbon bearing formation comprising:

providing a spoolable multi-string tubing system having two or more conduits and an auxiliary tubing string, the two or more conduits comprising a supply tubing string and a return tubing string;

providing a jet pump having a jet pump intake, a venturi nozzle, a venturi gap, a diffuser, and a jetting sub;

establishing fluid communication between the two or more conduits and the jet pump, and between the auxiliary tubing string and the jet pump;

deploying the jet pump into a wellbore;

supplying power fluid to the jet pump via the supply tubing string;

receiving return fluid from the jet pump via the return tubing string;

ceasing to supply power fluid to the jet pump;

ceasing to receive return fluid from the jet pump;

supplying jetting fluid to the jetting sub via the auxiliary tubing string;

flowing jetting fluid out of the jetting sub;

ceasing to flow jetting fluid out of the jetting sub;

supplying power fluid to the jet pump; and receiving return fluid from the jet pump.

In a further aspect, the present invention provides a system for producing formation fluids from a hydrocarbon bearing formation comprising. The system includes: a jet pump having a jet pump intake, a venturi nozzle, a venturi gap, and a diffuser; a permanent spoolable multi-string tubing system having two or more conduits for establishing fluid communication with the jet pump, the two or more conduits including a permanent supply tubing string and a permanent return tubing string; and a production spoolable multi-string tubing system having two or more conduits for establishing fluid communication with the jet pump and with the permanent spoolable multi-string tubing system, the two or more conduits including a production supply tubing string and a production return tubing string.

In an embodiment, the system further includes a cleanout spoolable multi-string tubing system having two or more conduits, the two or more conduits including a cleanout supply tubing string and a cleanout return tubing string, for establishing fluid communication between the two or more conduits of the cleanout spoolable multi-string tubing system and the two or more conduits of the permanent spoolable multi-string tubing system.

In an embodiment, the jet pump further includes a jetting sub for flowing jetting fluid out of.

In an embodiment, the jet pump further includes a jetting sub for flowing jetting fluid out of; the permanent spoolable multi-string tubing system further includes a permanent auxiliary tubing string for establishing fluid communication with the jet pump for supplying jetting fluid to the jetting sub; and the production spoolable multi-string tubing system further includes a production auxiliary tubing string for establishing fluid communication with the jet pump and with the permanent auxiliary tubing string.

In an embodiment, the jet pump further includes a data-sensing sub; the permanent spoolable multi-string tubing system further includes a permanent communications line for operatively connecting to the data-sensing sub; and the production spoolable multi-string tubing system further includes a production communications line for operatively connecting to the permanent communications line.

In an embodiment, the venturi nozzle, venturi gap, and diffuser are located on a carrier sub for unseating and conveying to the surface via the production supply tubing string and permanent supply tubing string returning to the surface when power fluid is supplied to the jet pump via the production return tubing string and permanent return tubing string.

Other aspects and features of the present invention will become apparent to one ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system for multi-string tubing jet pump system for fluid production.

System

Figure 1:
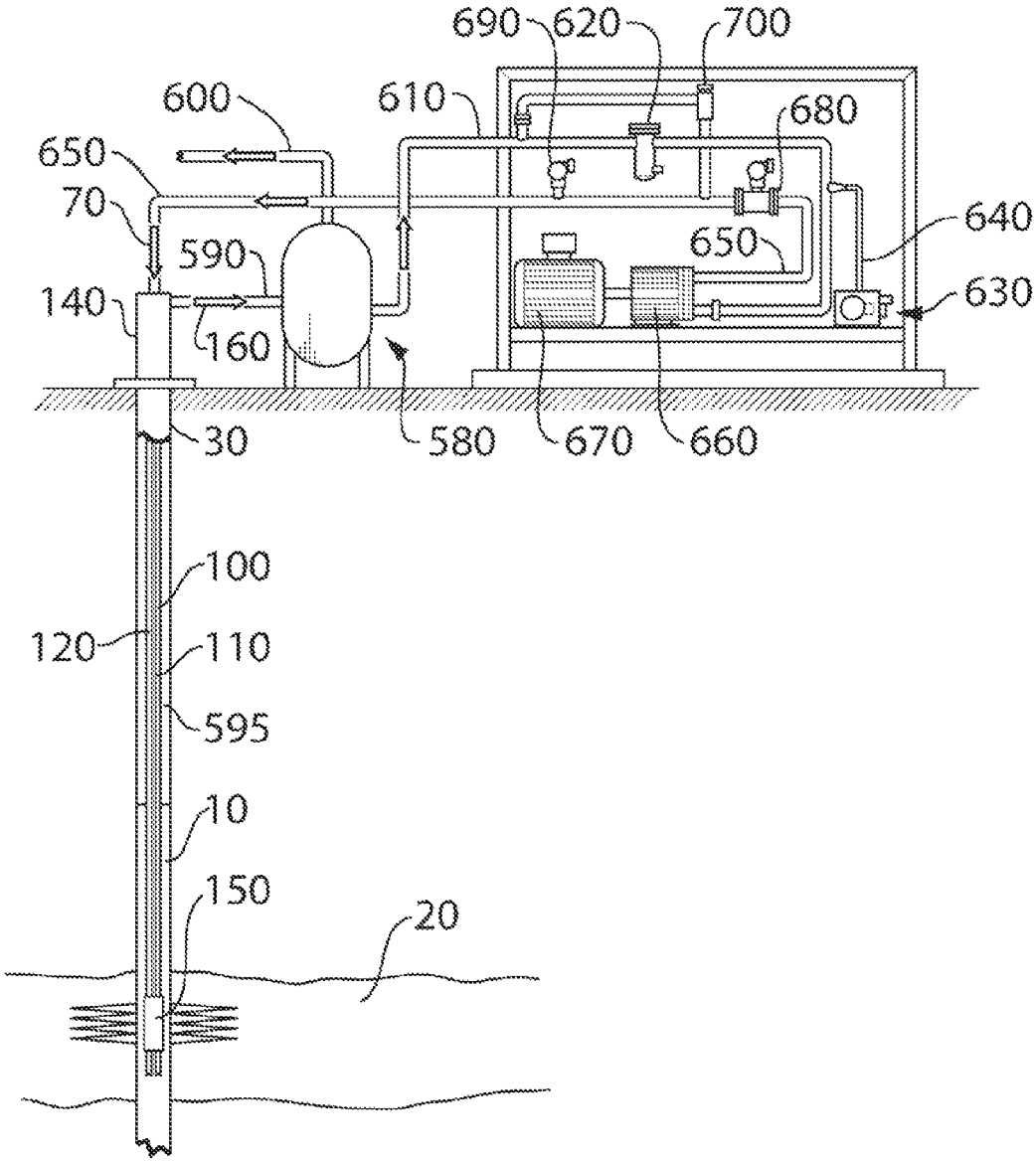
FIG. 1 is a schematic illustrating an embodiment of a fluid recovery system for producing formation fluid from a subsurface or subterranean hydrocarbon bearing formation of the present invention.

FIG. 1 depicts an embodiment of a fluid recovery system for producing formation fluid 10 from a subsurface or subterranean hydrocarbon bearing formation 20 via a wellbore 30. A jet pump 150 is run on the end of a Spoolable, Multi-string Tubing System (SMTS) 100. The SMTS 100 may include two or more conduits, for example a supply tubing string 110 and a return tubing string 120. The SMTS 100 is hung off in the wellhead 140 which is configured to provide separate surface tie-ins for each of the tubing strings in the SMTS 100. The SMTS 100 is run through a wellbore 30. The wellbore 30 may be cased.

Power fluid 70 may flow from the injection line 650 to the supply tubing string 110 of the SMTS 100. The power fluid 70 is typically either water- or hydrocarbon-based. The downhole end of the SMTS 100 is in fluid communication with the jet pump 150, which is deployed into the wellbore 30 to produce formation fluid 10. Inside the jet pump 150, formation fluid 10 is combined with the power fluid 70; the resulting combination is return fluid 160. Return fluid 160 may be used as power fluid 70.

Return fluid 160 may flow from the return tubing string 120 to a production handling system 580 via a surface flowline 590. This process operates on an on-going basis to continuously produce formation fluid 10 from the hydrocarbon bearing formation 20. Gas flow (not shown) from the hydrocarbon bearing formation 20 may flow up through up through an annulus 595 in the wellbore 30 to a production handling system 580 via a surface flowline 590.

At the production handling system, produced return fluid 160 may flow through the sales line 600 for further processing or other use. A fixed quantity of return fluid 160 may remain in the production handling system for use as power fluid 70 in the jet pump 150. Return fluid 160 may flow through a pump skid suction line 610 and solids may be removed by an in-line filter system 620.

A chemical injection pump 630 may be present and in fluid communication with the pump skid suction line 610 via a chemical injection line 640. The chemical injection pump 630 may be used to administer chemicals to, for example, prevent scale and corrosion, and mitigate the detrimental effects to the SMTS 100 and jet pump 150 of exposure to, for example, paraffin. The return fluid 160 will flow to one or more pumps 660, which may be driven by one or more motors 670. Return fluid 160 that will now be used as (and referred to as) power fluid 70 flows into the injection line 650. A flow meter 680 may be present to measure the flow rate of the power fluid 70. A pressure indicator 690 (for example a pressure transducer or pressure gauge) may be present to measure pressure in the injection line 650. A pressure relief valve 700 may be present to release excessive pressure into the pump skid suction line 610, which has a lower pressure than the injection line 650.

Jet Pump

Figure 2:
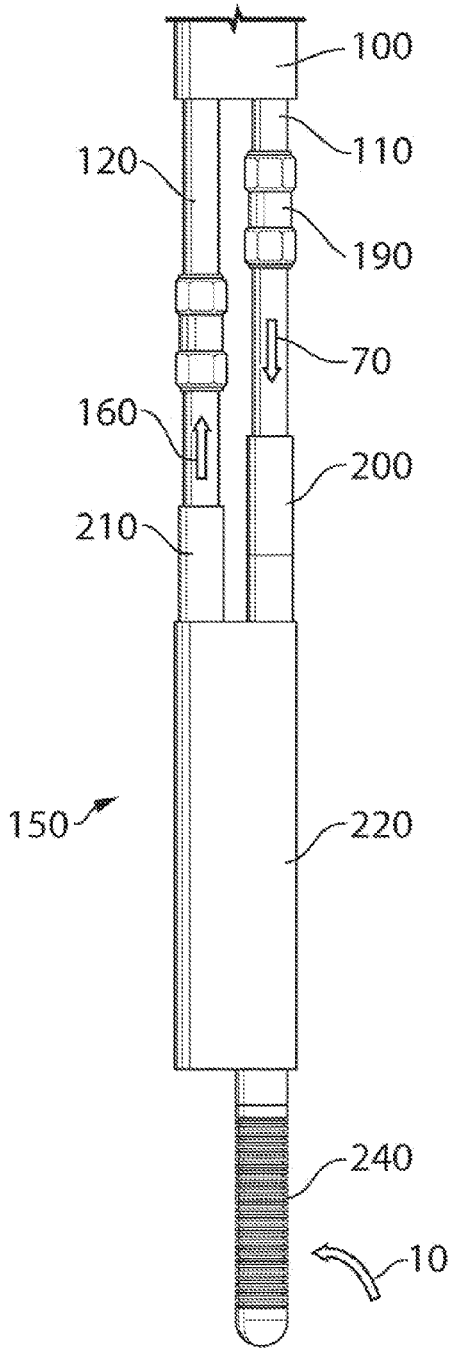
FIG. 2 is a jet pump of the present invention.

FIG. 2 depicts an embodiment of a jet pump 150 for use with a SMTS 100 wherein the SMTS 100 includes a supply tubing string 110 and a return tubing string 120. Connectors 190 connect a power fluid inlet 200 and the supply tubing string 110, and a return fluid outlet 210 and the return tubing string 120. The connectors 190 may be threaded, welded, or otherwise adapted to connect the jet pump body 220 with the supply tubing string 110 and the return tubing string 120. The jet pump body 220 may, for example, have a unibody design (as illustrated), or be a dual barrel jet pump body (not shown).

Power fluid 70 flows through the power fluid inlet 200 into the jet pump body 220, causing formation fluid 10 to flow into the jet pump body 220 through a jet pump intake 240. Power fluid 70 and formation fluid 10 are combined as return fluid 160 in the jet pump body 220. The return fluid 160 flows from the jet pump body 220 and into the return fluid outlet 210.

Figure 3:
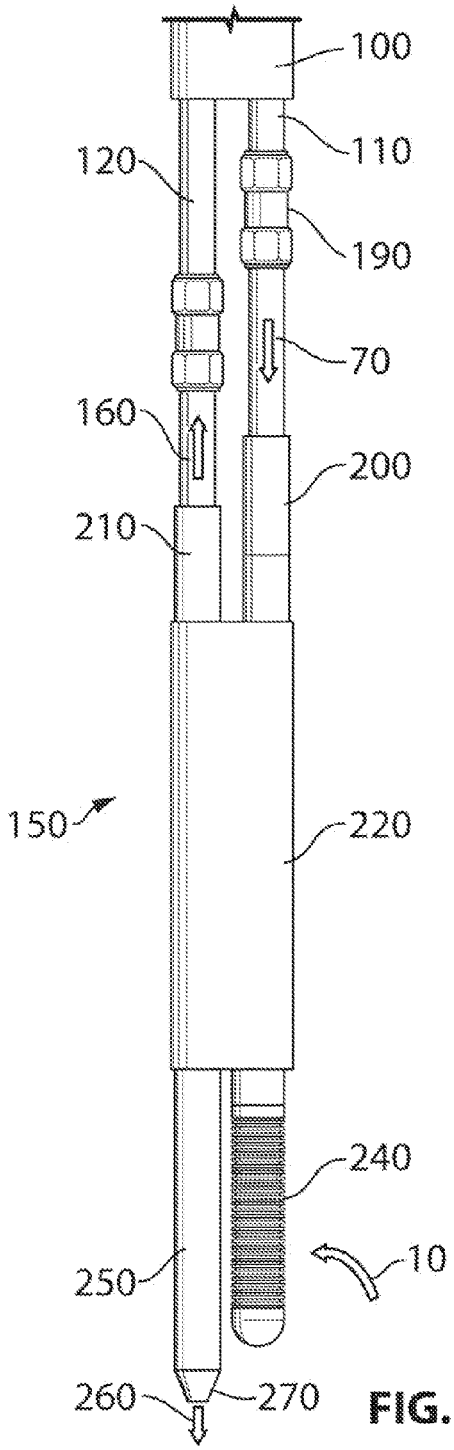
FIG. 3 is a jet pump of the present invention having a jetting sub.

FIG. 3 depicts an embodiment of a jet pump 150 having a jetting sub 250. The jet pump body 220 may be adapted to direct power fluid 70 or return fluid 160 to a jetting sub 250. Jetting fluid 260 flows out of a jetting nozzle 270. Jetting fluid 260 is any fluid, for example power fluid 70, return fluid 160, or wellbore treatment fluid (not shown), that flows to the jetting sub 250.

SMTS

Figure 4:
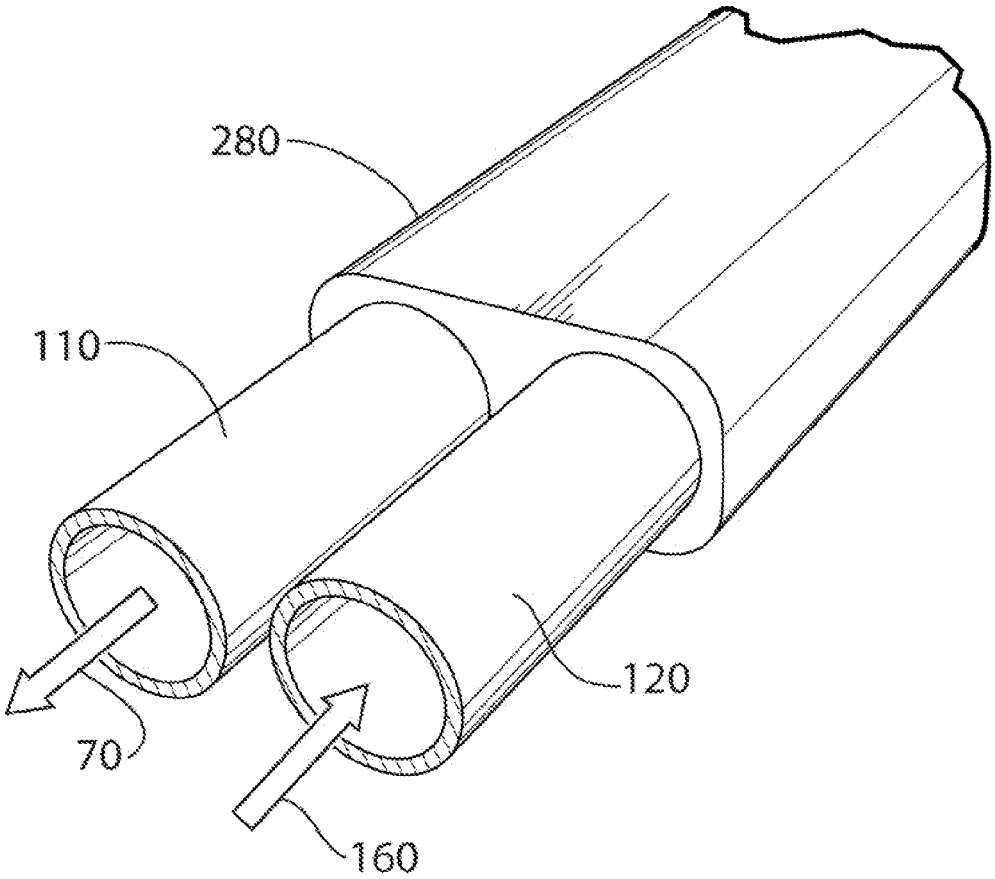
FIG. 4 is a spoolable multi-string tubing system for use with a jet pump of FIG. 2 or 3.

FIG. 4 depicts an embodiment of the SMTS 100 for use with the jet pump 150 of FIG. 2. The supply tubing string 110 and the return tubing string 120 may be encapsulated in a single bundle 280 to facilitate deployment or retrieval with a single running operation using a conventional coiled tubing unit with modified injector chains. The bundle 280 may include an exterior polymer coating that is resistant to the effects of exposure to corrosive gases and fluids. The supply tubing string 110 and the return tubing string 120 are substantially parallel with one another. As illustrated by FIG. 4, the supply tubing string 110 and the return tubing string 120 may be laterally disposed with respect to one another. The tubing string 110 and the return tubing string 120 may abut along their long axes or, as illustrated in FIG. 4, may be positioned apart from one another.

When using the SMTS 100, only a single coiled tubing unit (FIG. 24) is necessary to install or retrieve the tubing string, reducing the time required for such operations compared to use of concentric tubing. Further, in some cases the size of the wellbore casing will be too restrictive to allow the use of concentric tubing but will be suitable for use of a SMTS 100.

Jet Pump Body

Figure 5:
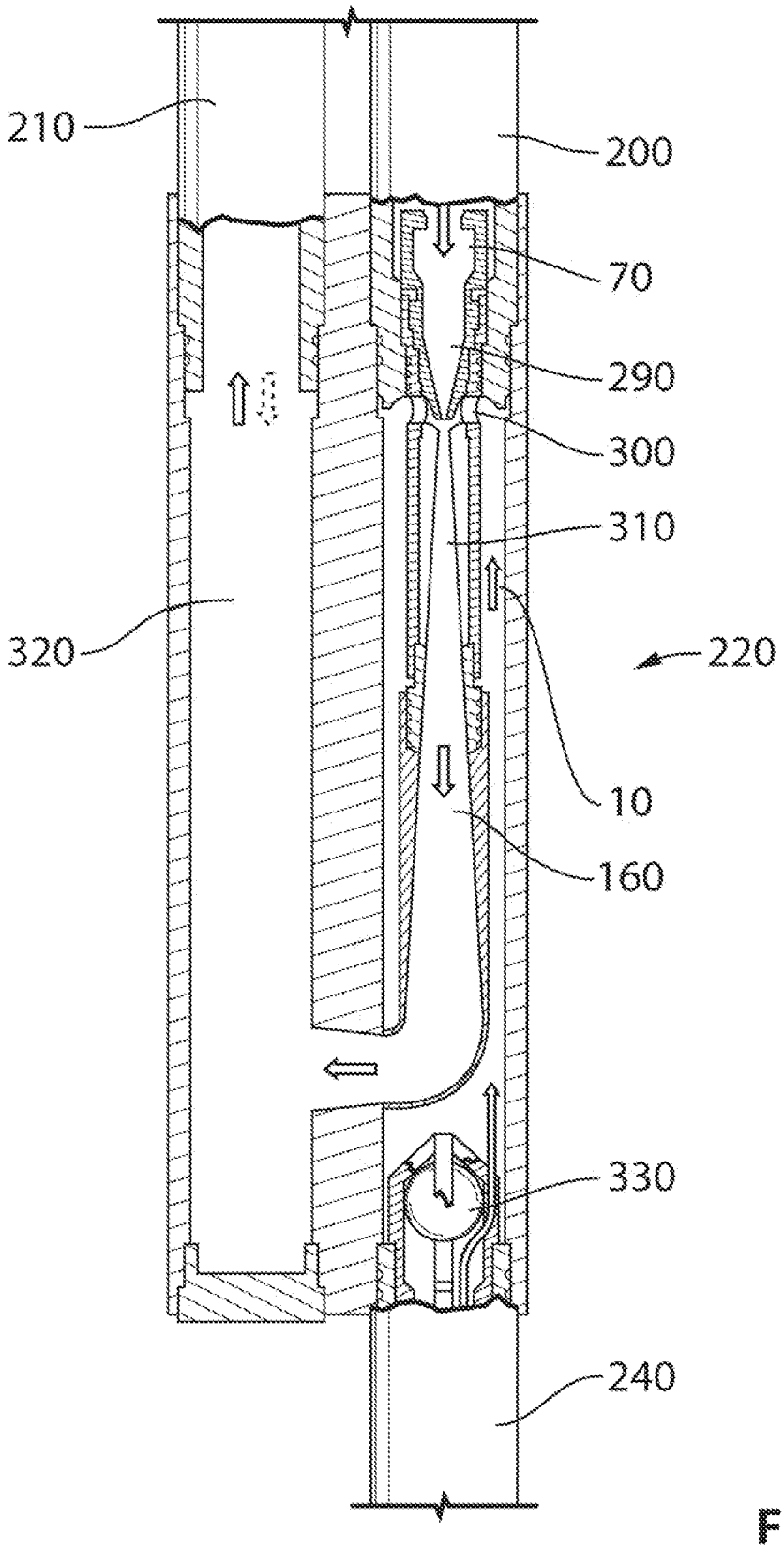
FIG. 5 is a cross section of one embodiment of a jet pump body of the jet pump of FIG. 2.

FIG. 5 is a cross-section of one embodiment of the jet pump body 220 of FIG. 2. Power fluid 70 flows into a venturi nozzle 290. While flowing through the venturi nozzle 290, the power fluid 70 flows past a venturi gap 300 between the venturi nozzle 290 and a diffuser 310, creating a low pressure condition at the venturi gap 300. The low pressure condition causes formation fluid 10 to flow into a jet pump intake 240 and to the venturi gap 300. Upon entering the venturi gap 300 and the diffuser 310, formation fluid 10 combines with power fluid 70, forming return fluid 160. The return fluid 160 flows through a return tube 320 and into a return fluid outlet 210.

Figure 18:
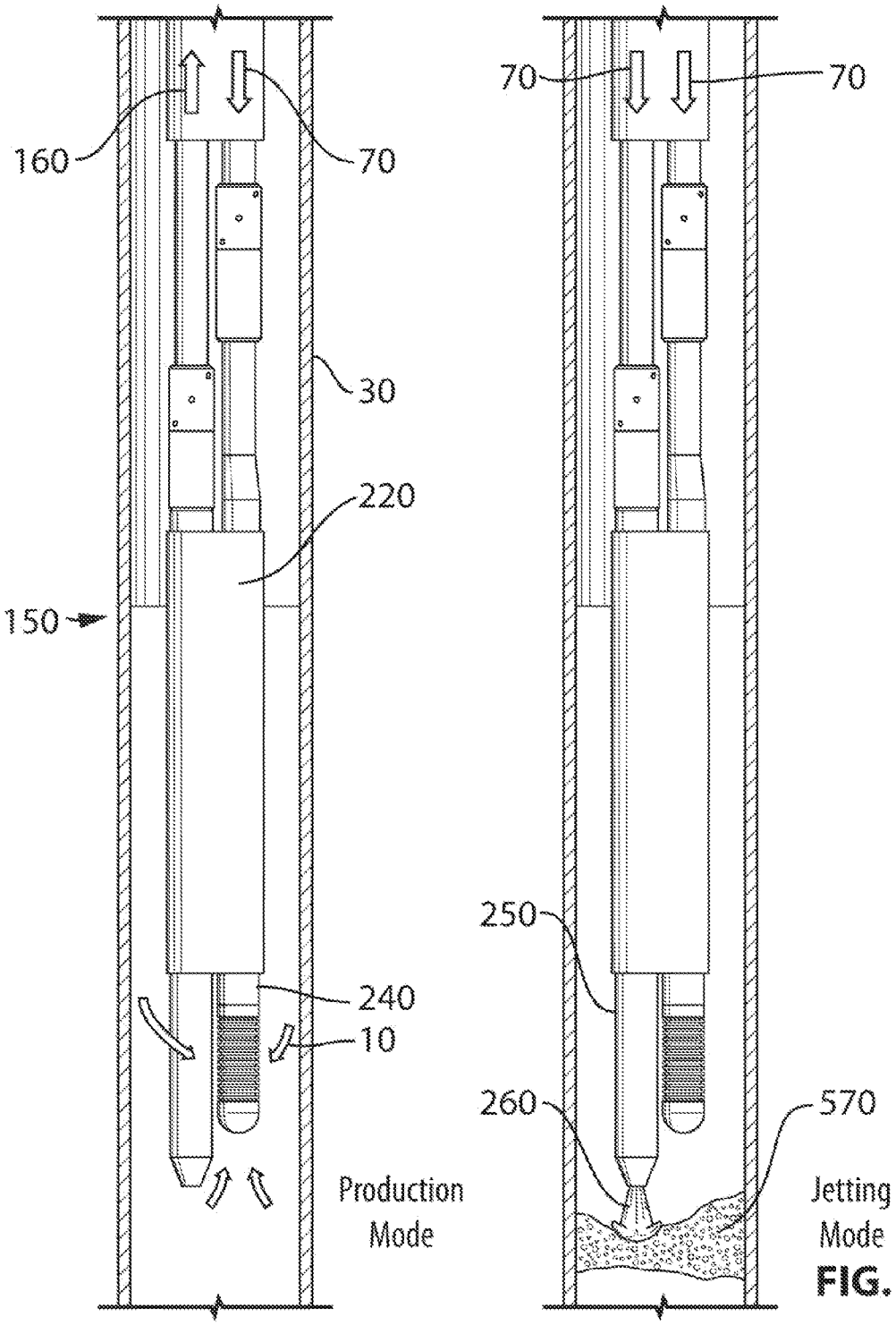
FIG. 18 depicts a method of the present invention of using one embodiment of a jet pump and spoolable multi-string tubing system to sequentially produce formation fluid and eliminate obstructions from a wellbore.

A check valve 330 may prevent backflow when flowing power fluid 70 is not flowing through the venturi nozzle 290, as may occur, for example, when the jet pump 150 (FIG. 2) is in a jetting mode (see FIG. 18).

Figure 6:
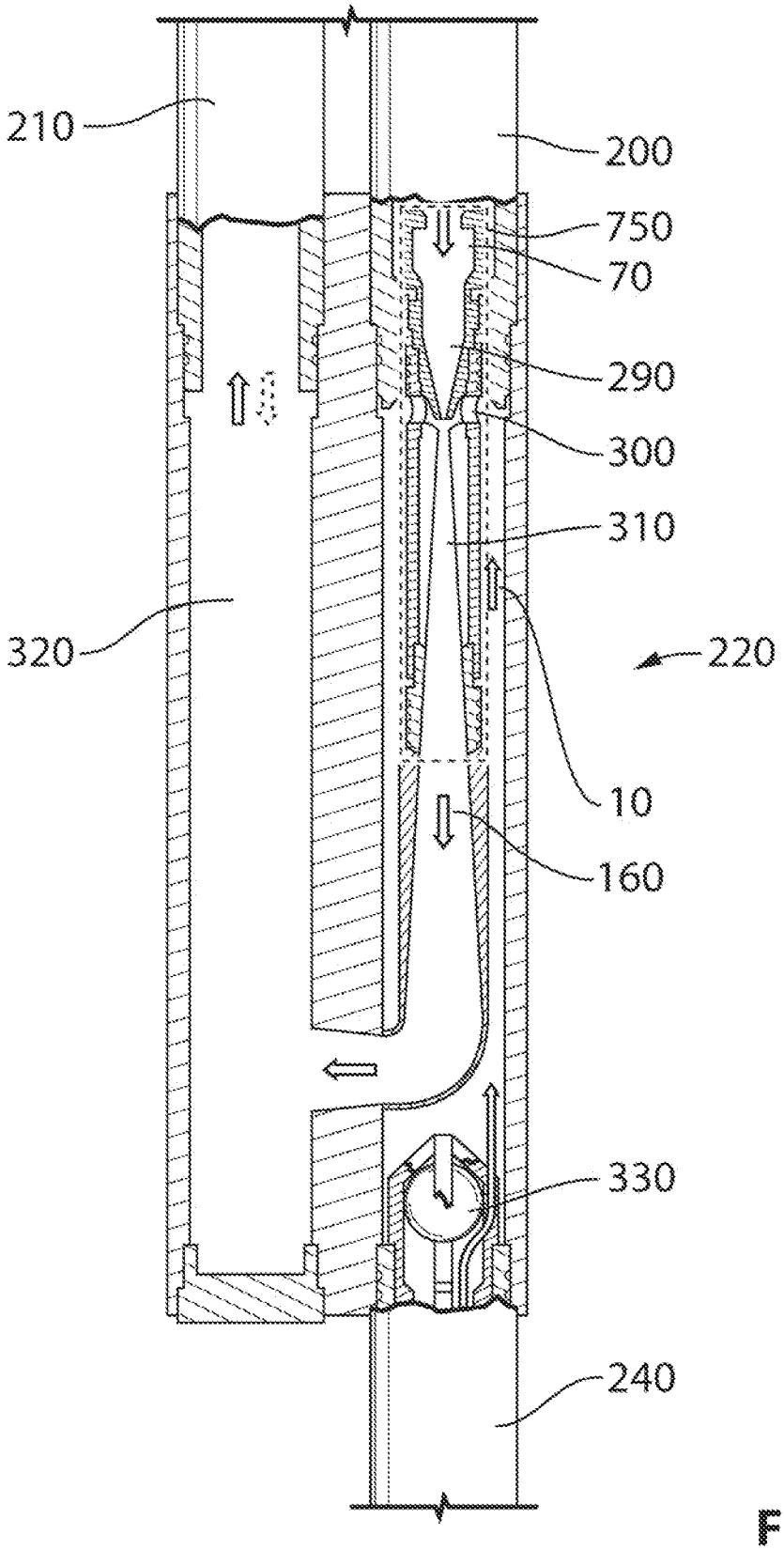
FIG. 6 is a cross section of a further embodiment of a jet pump body of the jet pump of FIG. 2 having a carrier sub.

FIG. 6 is a cross section of a further embodiment of the jet pump body 220 wherein the venturi nozzle 290, the venturi gap 300, and a diffuser 310 are all located on a carrier sub 750. The carrier sub 750 is seated in the jet pump body 220 during normal production operations, but is not integral with the jet pump body 220. The carrier sub 750 is adapted to travel up the supply tubing string 110 of the SMTS 100 via the power fluid inlet 200. To cause the carrier sub 750 to travel up the supply tubing string 110, the flow of power fluid 70 from the power fluid inlet 200 and the flow of return fluid 160 into the return fluid outlet 210 are reversed, and power fluid 70 is supplied to the jet pump 150 via the return tubing string 120 to unseat the carrier sub and convey it to the surface. The carrier sub 750 may then be returned to the jet pump body 220 by resuming normal flow of power fluid 70 from the power fluid inlet 200 and the flow of return fluid 160 into the return fluid outlet 210, and by supplying power fluid 70 to the jet pump via the supply tubing string to seat the carrier sub 750 in the jet pump 150. Alternatively, a second carrier sub (not shown) may take the place of the carrier sub 750. The carrier sub 750, and with it the venturi nozzle 290, the venturi gap 300, and a diffuser 310, may be circulated to the surface without withdrawing the jet pump 150 from the wellbore 30. The carrier sub 750 and its use thus allow retrieval of the venturi nozzle 290, the venturi gap 300, and a diffuser 310 to facilitate, for example, inspection, cleaning, or changing parts.

Figure 7:
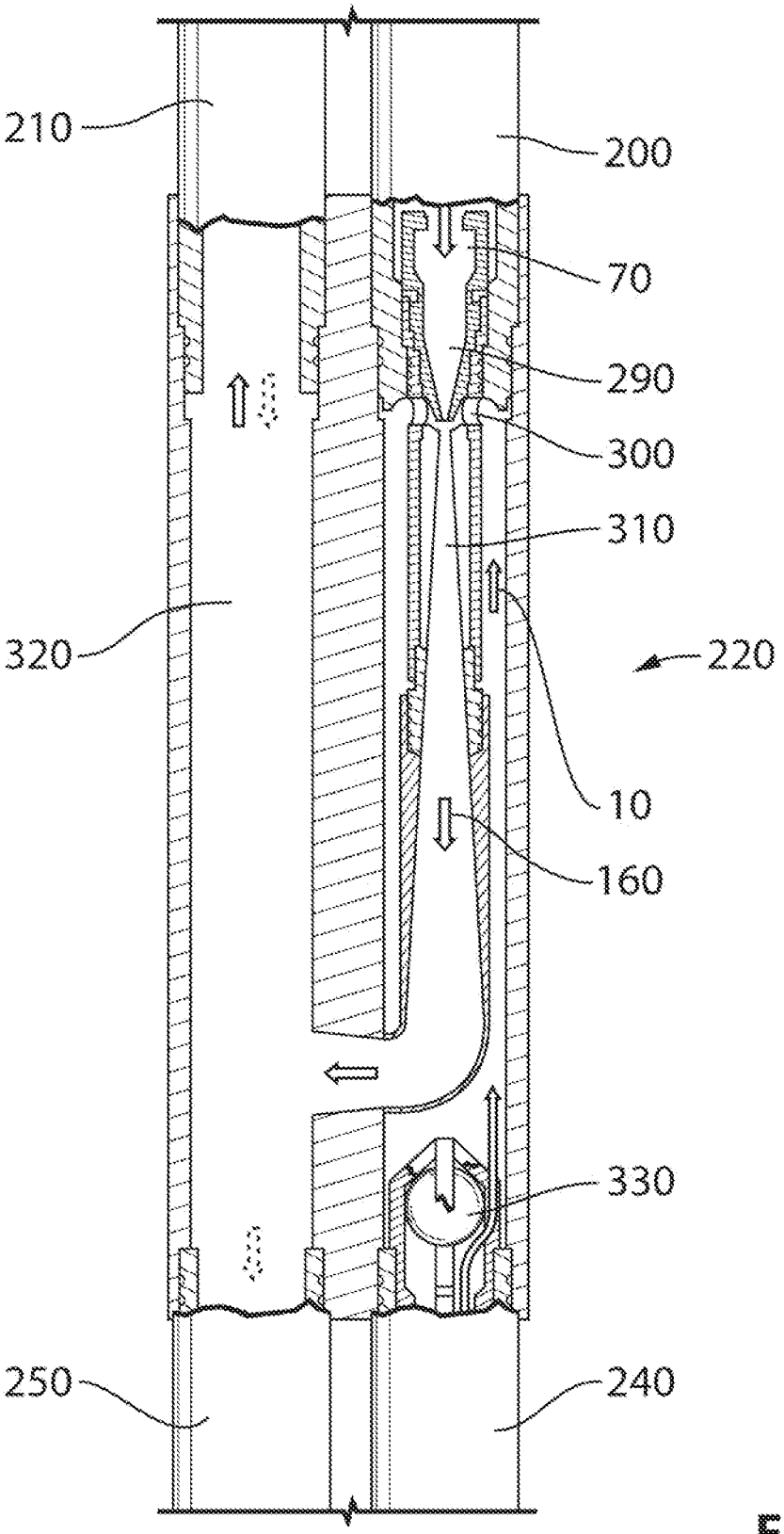
FIG. 7 is a cross section of one embodiment of a jet pump body of the jet pump of FIG. 3.

FIG. 7 is a cross section of a further embodiment of the jet pump body 220 wherein the jet pump body 220 includes a jetting sub 250. At least a portion of the return fluid 160 may flow through the return tube 320 into the jetting sub 250.

Jet Pump with Auxiliary Tubing String

Figure 8:
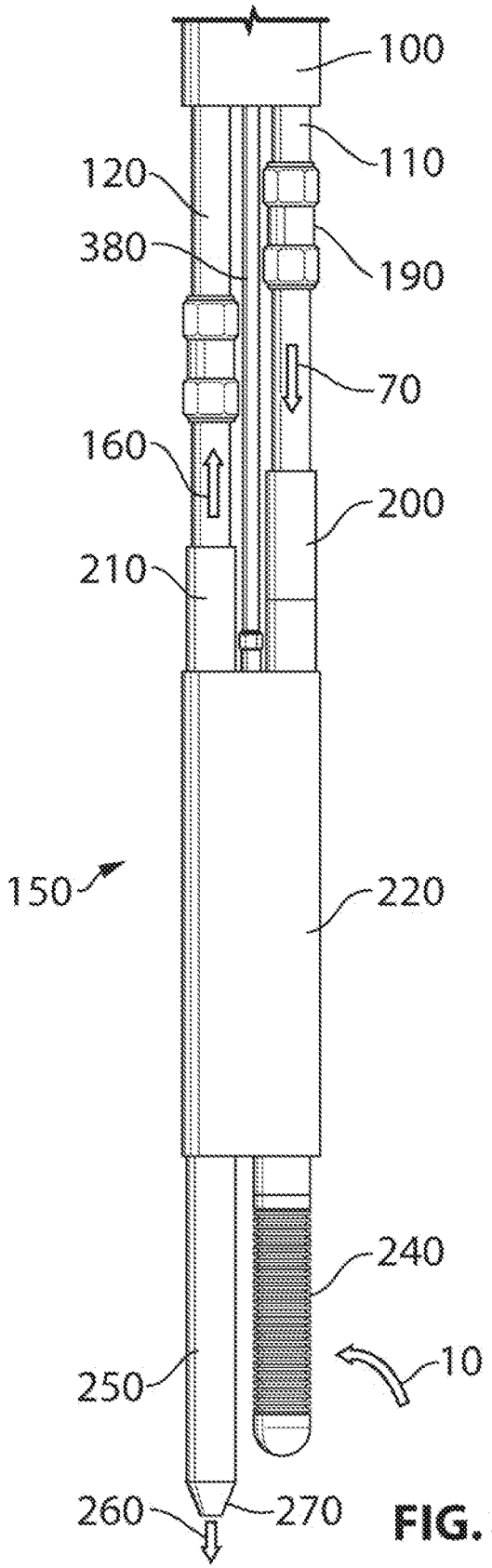
FIG. 8 is a jet pump of the present invention having an auxiliary tubing string.
Figure 9:
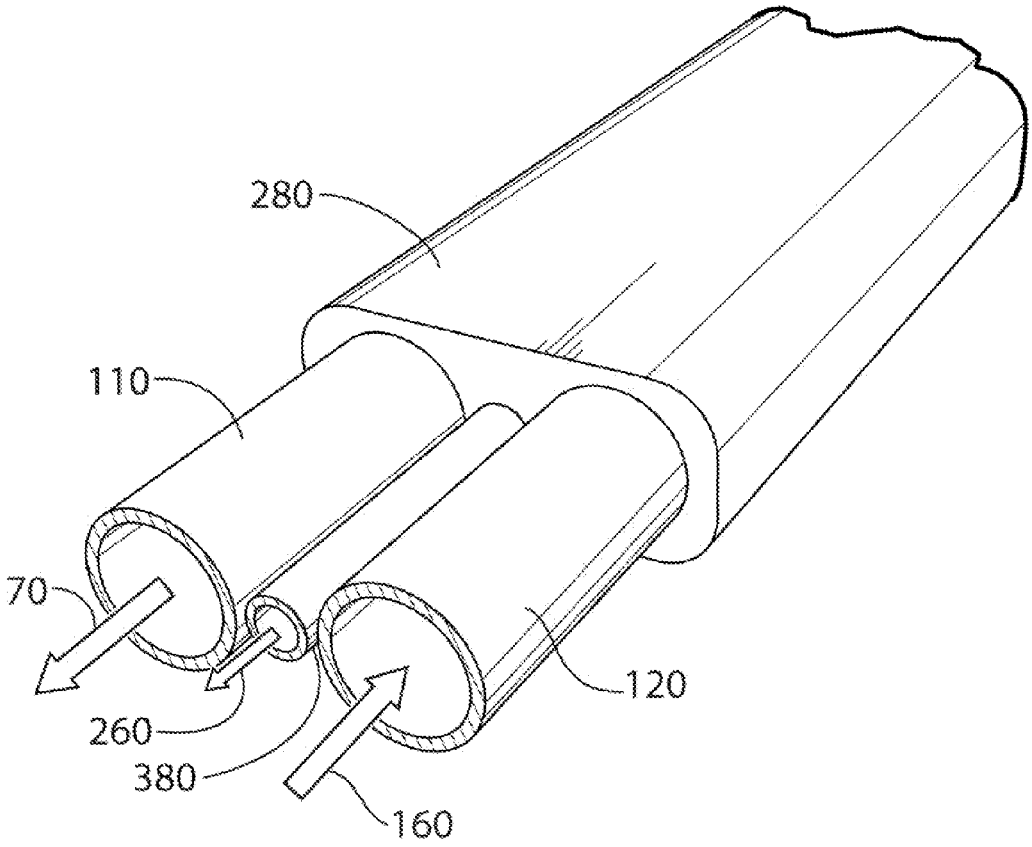
FIG. 9 is a spoolable multi-string tubing system for use with the jet pump of FIG. 8.

FIGS. 8 and 9 depict an embodiment of a jet pump 150 for use with a SMTS 100 wherein the SMTS 100 includes an auxiliary tubing string 380. A supply tubing string 110, a return tubing string 120, and the auxiliary tubing string 380 are encapsulated in a single bundle 280. The supply tubing string 110, the return tubing string 120, and the auxiliary tubing string 380 are all substantially parallel with, and laterally disposed with respect to, one another. A jetting sub 250 may be in fluid communication with the auxiliary tubing string 380. Jetting fluid 260 flows from the auxiliary tubing string 380 to the jetting sub 250.

Figure 10:
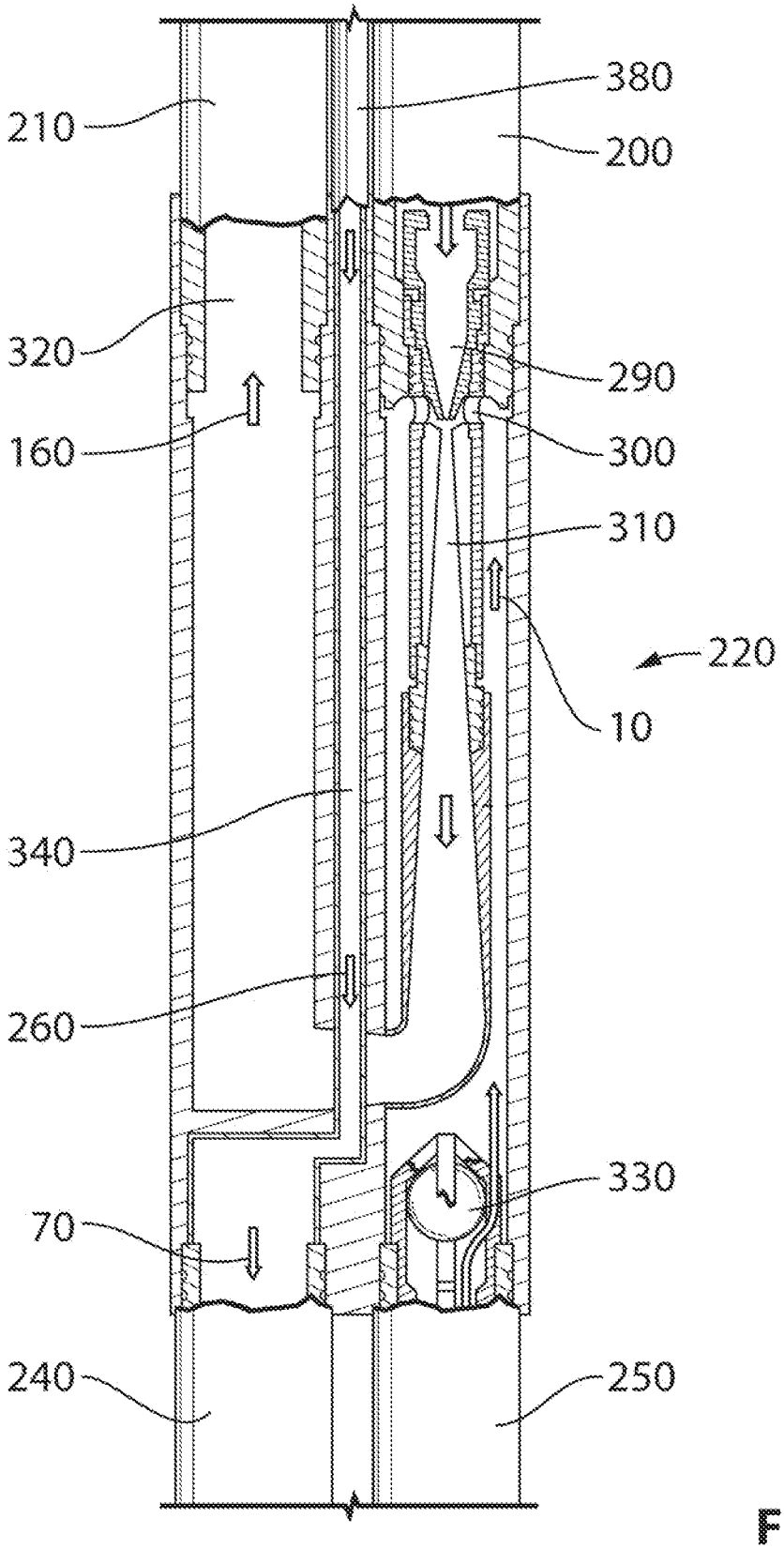
FIG. 10 is a cross section of a jet pump body of the jet pump of FIG. 8.

FIG. 10 is a cross-section of the jet pump body 220 of FIG. 8 wherein an auxiliary tubing string 380 is in fluid communication with a jetting flow passage 340 through which jetting fluid 260 flows to the jetting sub 250.

Jet Pump with Data-Sensing Sub

Figure 11:
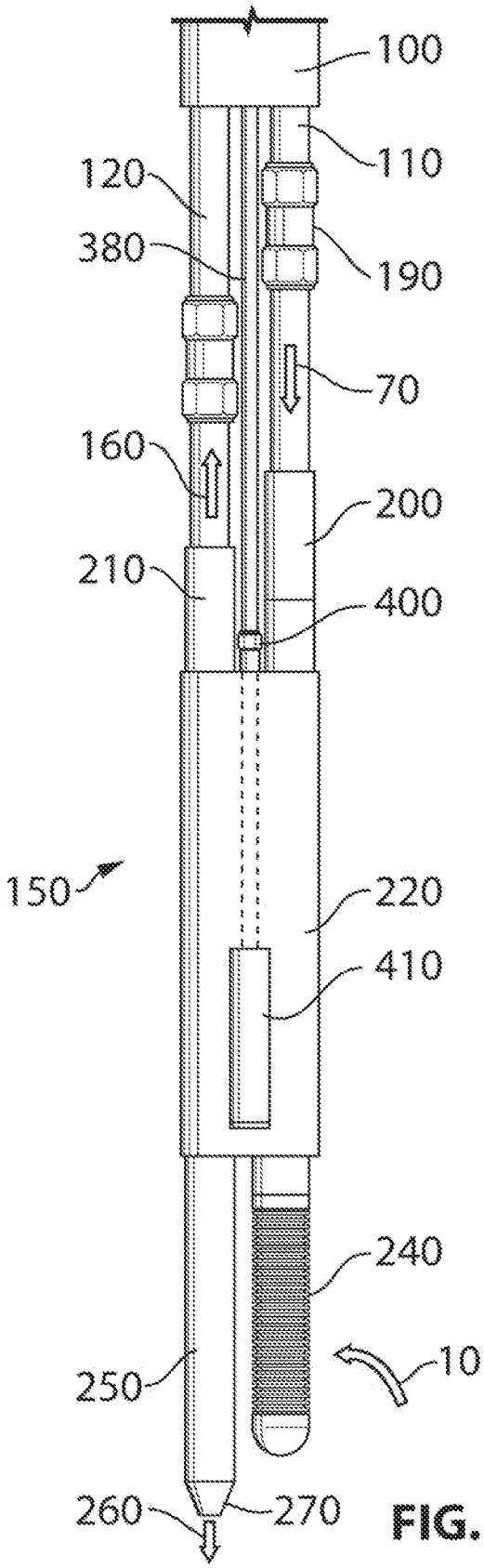
FIG. 11 is a jet pump of the present invention having a data-sensing sub.
Figure 12:
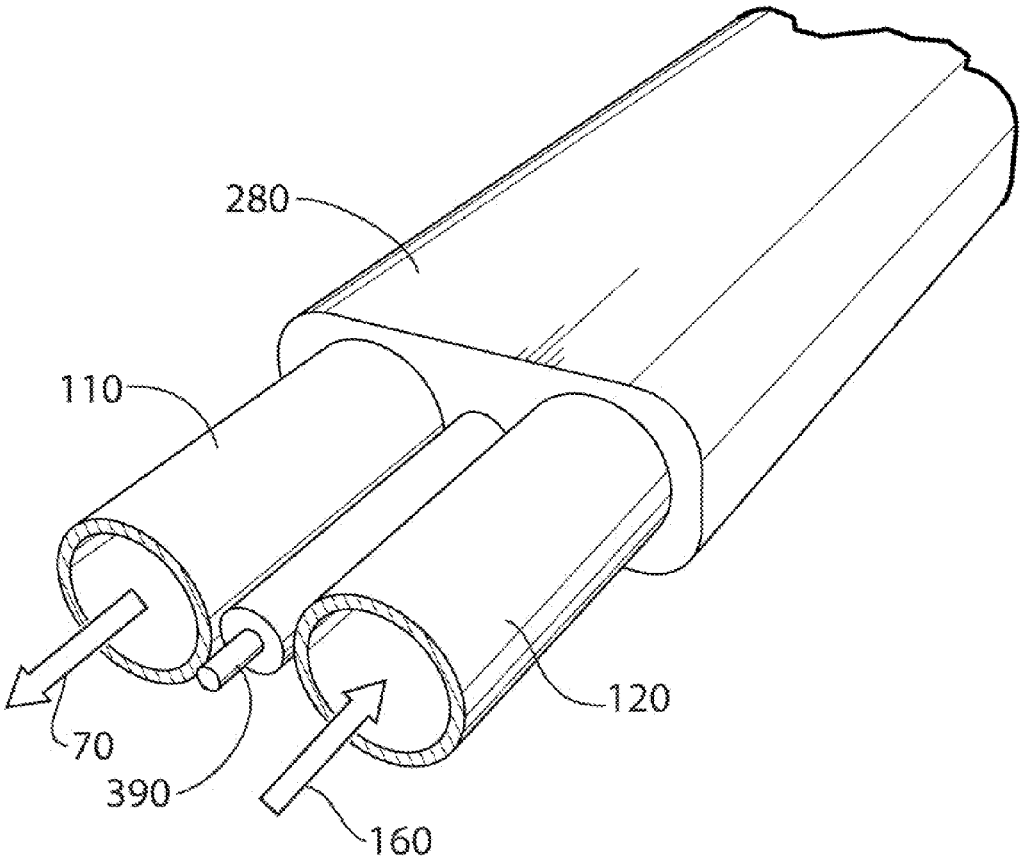
FIG. 12 is a spoolable multi-string tubing system for use with the jet pump of FIG. 11.

FIGS. 11 and 12 depict an embodiment of a jet pump 150 for use with a SMTS 100 wherein the SMTS 100 includes a communications line 390. A supply tubing string 110, a return tubing string 120, and the communications line 390 are encapsulated in a single bundle 280. The supply tubing string 110, the return tubing string 120, and the communications line 390 are all substantially parallel with, and laterally disposed with respect to, one another. The communications line 390 may be a small tubing string or an electrical conductor, include, for example, hydraulic, electric, or fiber optic communication means. A communications connector 400 operatively connects a data-sensing sub 410 with the communications line 390. The communications connector 400 may be threaded, welded, or otherwise adapted to operatively connect the data-sensing sub 410 with the communications line 390. When data such as bottomhole pressure, temperature, or both are required, data from the data-sensing sub 410 is received at the surface electronically or through pressure communication. Examples of data that the data-sensing sub 410 may be adapted to receive include temperature and pressure.

Jetting Sub

Figure 13:
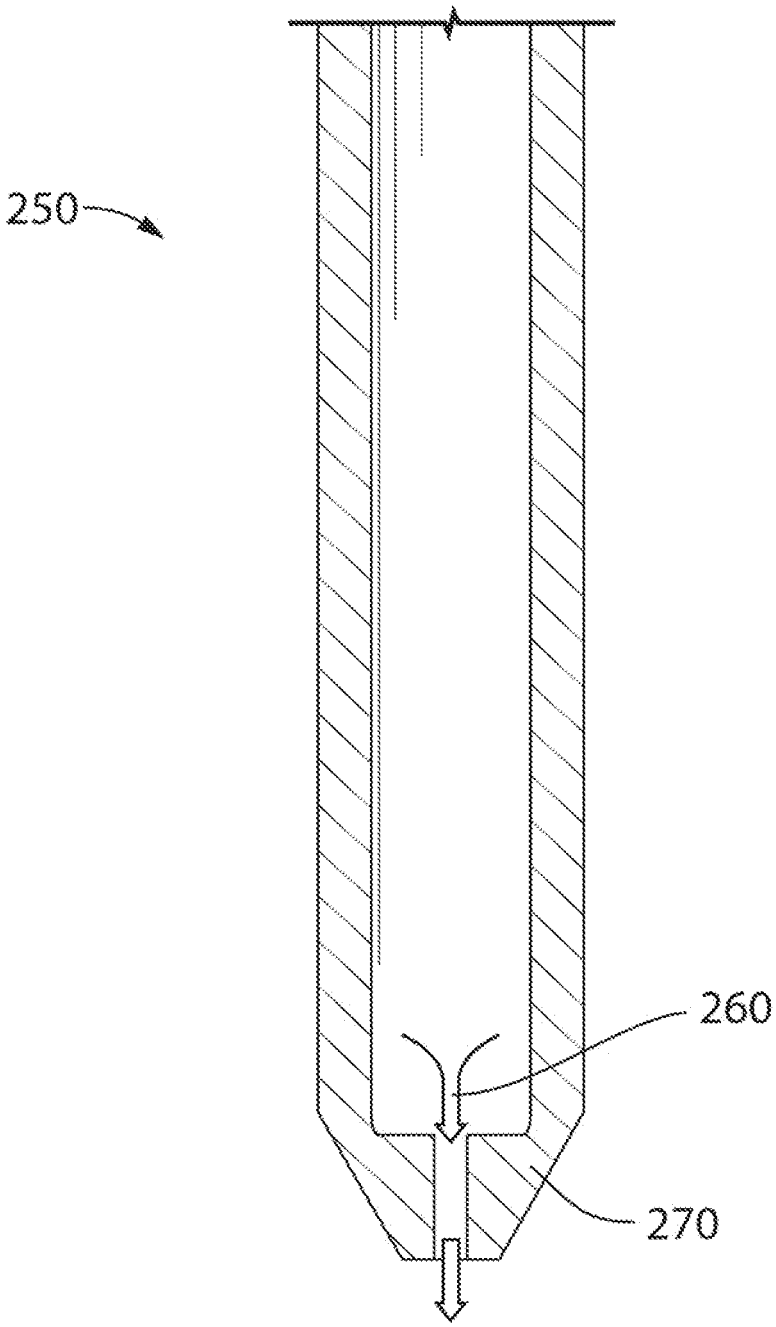
FIG. 13 is a jetting sub of the present invention.

FIG. 13 depicts a jetting sub 250 for a jet pump 150, with a jetting nozzle 270. Jetting fluid 260 flows from a jet pump body 220, through the jetting sub 250, and out the jetting nozzle 270.

Figure 14:
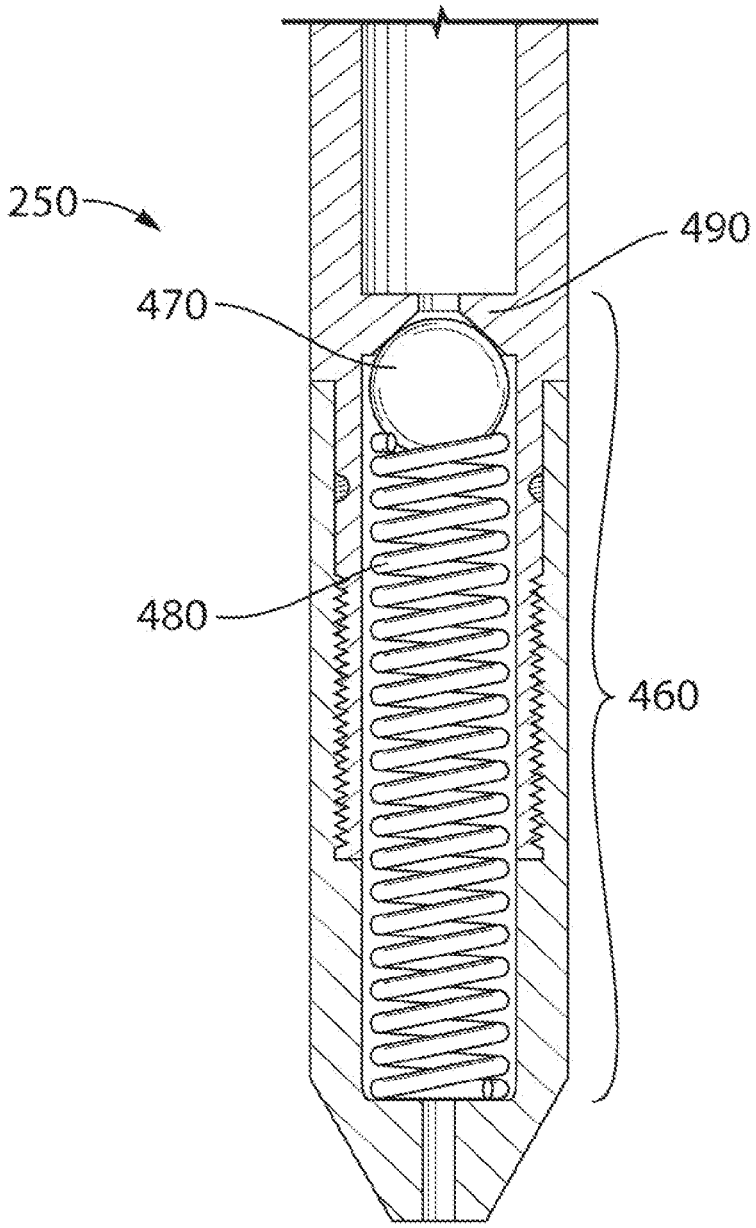
FIG. 14 is a jetting sub of the present invention having a back-pressure valve.

FIG. 14 depicts a jetting sub 250 for a jet pump 150 wherein access by jetting fluid 260 to the jetting nozzle 270 is subject to a back-pressure valve 460. The back-pressure valve 460 may include, for example, a ball 470, a spring 480, and a seat 490. The back-pressure valve 460 may be adapted to open at a selected back-pressure setting. The back-pressure setting is selected by selecting a spring rate, distance, or combination thereof, of the spring 480. When fluid pressure equal to or greater than the back-pressure setting is applied, the spring 480 is compressed and jetting fluid 260 flows through the jetting nozzle 270.

Jetting Nozzle

Figure 15:
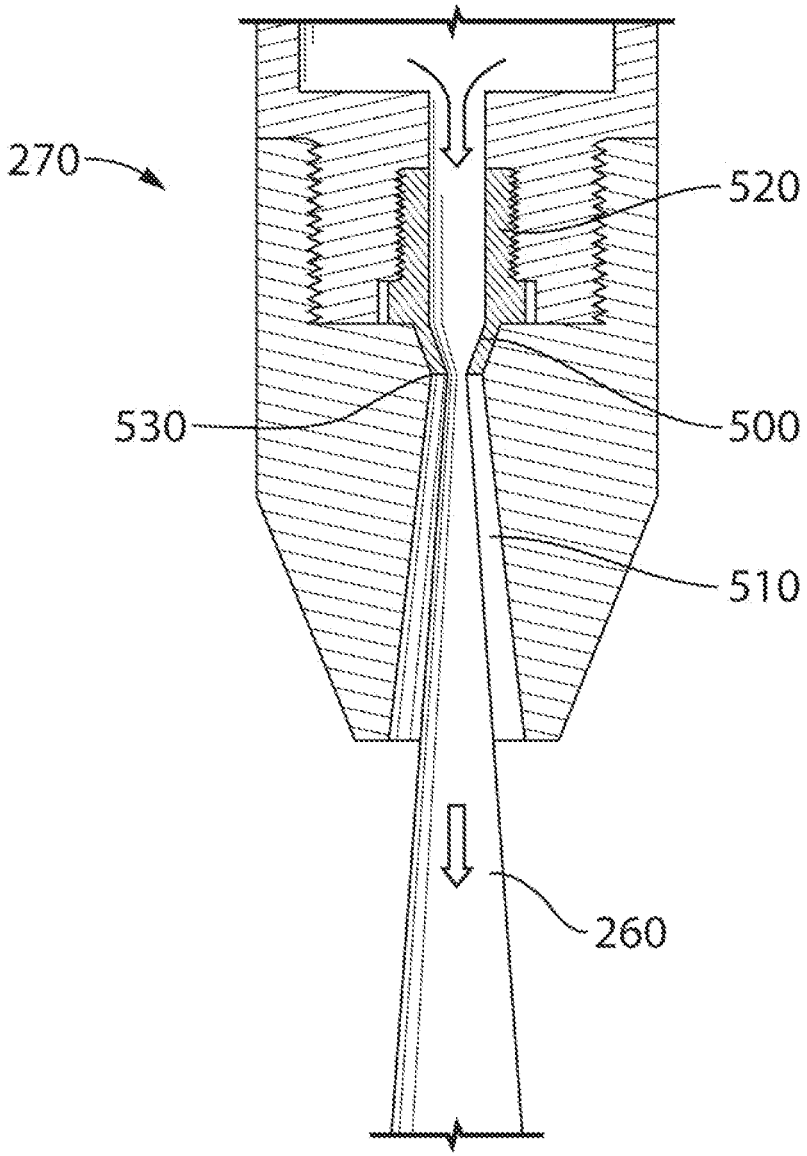
FIG. 15 is one embodiment of a jetting nozzle of the present invention.

FIG. 15 depicts a jetting nozzle 270 for a jetting sub 250 wherein jetting fluid 260 flows through a converging jetting passage 500 and a diverging jetting passage 510. The diverging jetting passage 510 may be present on a threaded insert 520. The converging jetting passage 500 and the diverging jetting passage 510 form a jetting pinch 530. The jetting pinch 530 is sized to provide back-pressure for the jetting nozzle 270. Entrained particulates that flow in the jetting fluid 260 will eddy in the diverging jetting passage 510 preferentially to in the converging jetting passage 500, protecting the converging jetting passage 500 from damage.

Jet Pump Intake

Figure 16:
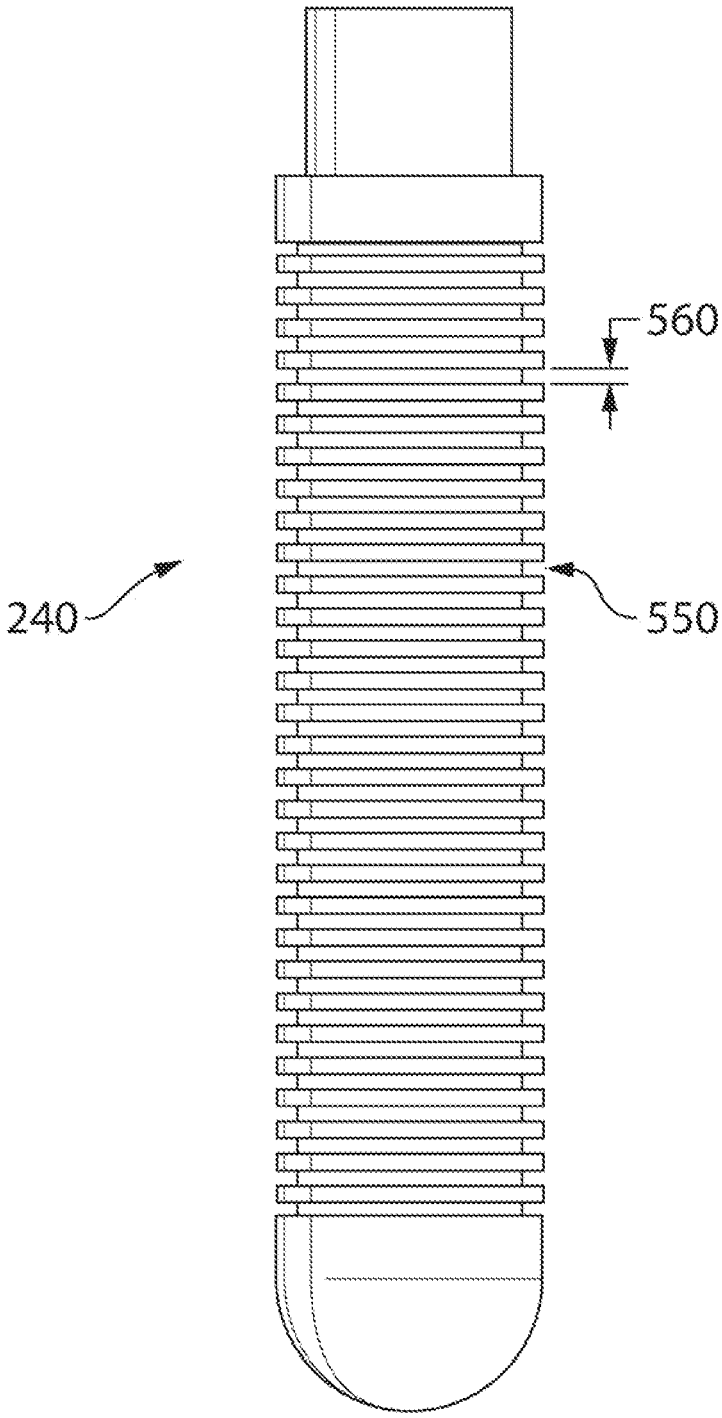
FIG. 16 is a jet pump intake of the present invention.

FIG. 16 depicts a jet pump intake 240 for a jet pump 150, which includes slots 550. A dimension 560 of the slots 550 is selected based on the size of a venturi gap 300 in the jet pump body 220 (FIG. 5) and the size of any material in the wellbore 30 which may enter the jet pump intake 240. The dimension 560 is selected to be large enough to admit most particulates that will be found in a given wellbore 30 but small enough to prevent intake of particulates that are large enough to plug the venturi gap 300.

Method of Using a Jet Pump

Figure 17:
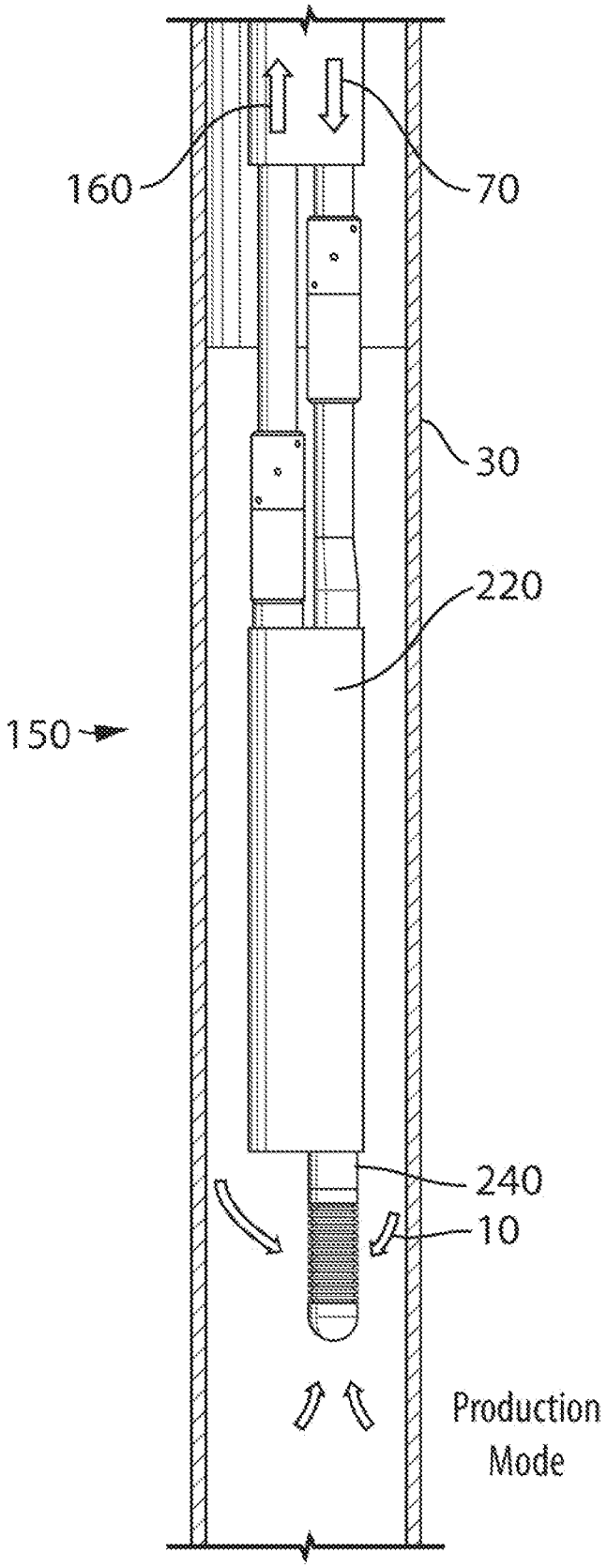
FIG. 17 depicts a method of the present invention of using one embodiment of a jet pump and spoolable multi-string tubing system to produce formation fluid.

FIG. 17 illustrates one embodiment of a method of using a jet pump 150 to produce formation fluid 10. The jet pump 150 includes a jet pump body 220, a jetting sub 250 and a jet pump intake 240. Formation fluid 10 may be pumped to the surface by the jet pump 150.

Method of Using a Jet Pump Including a Jetting Sub

FIG. 18 illustrates one embodiment of a method of using a jet pump 150 to produce formation fluid 10. The jet pump 150 includes a jet pump body 220, a jetting sub 250 and a jet pump intake 240. The jetting sub 250 includes a jetting nozzle 270. Formation fluid 10 may be pumped to the surface by the jet pump 150 (production mode). If a wellbore obstruction 570 (for example a sand bridge) is present, suction at the jet pump intake 240 may cease and jetting fluid 260 may be emitted from the jetting nozzle 270 to disperse the wellbore obstruction 570 (jetting mode). Once the wellbore obstruction 570 is sufficiently dispersed, emission of jetting fluid 260 from the jetting nozzle 270 may cease and production of formation fluid 10 by the jet pump 150 may be resumed. Dispersal of a wellbore obstruction 570 is provided as an example and is not the sole application of emission of jetting fluid 260 from the jetting sub 250.

Changing from the production mode to the jetting mode may be accomplished by reconfiguring a return tubing string 120 such that power fluid 70 is supplied to the jet pump body 220 through both a supply tubing string 110 and the return tubing string 120. The same change may be accomplished by blocking the return tubing string 120. Changing from the jetting mode to the production mode may be accomplished by reconfiguring the return tubing string 120 to remove return fluid 160. A jet pump 150 having a jet pump body 220 as in FIG. 7 is suitable for use in the method of FIG. 18. Other embodiments of a jet pump body 220, which may, for example, include a jetting sub 250 having a back-pressure valve 460 (FIG. 14) may allow simultaneous emission of jetting fluid 260 from the jetting nozzle 270 while producing formation fluid 10. Simultaneous emission of jetting fluid 260 from the jetting nozzle 270 while producing formation fluid 10 may be intermittent with merely producing formation fluid or may be constant.

Method of Using a Jet Pump Including an Auxiliary Tubing String

Figure 19:
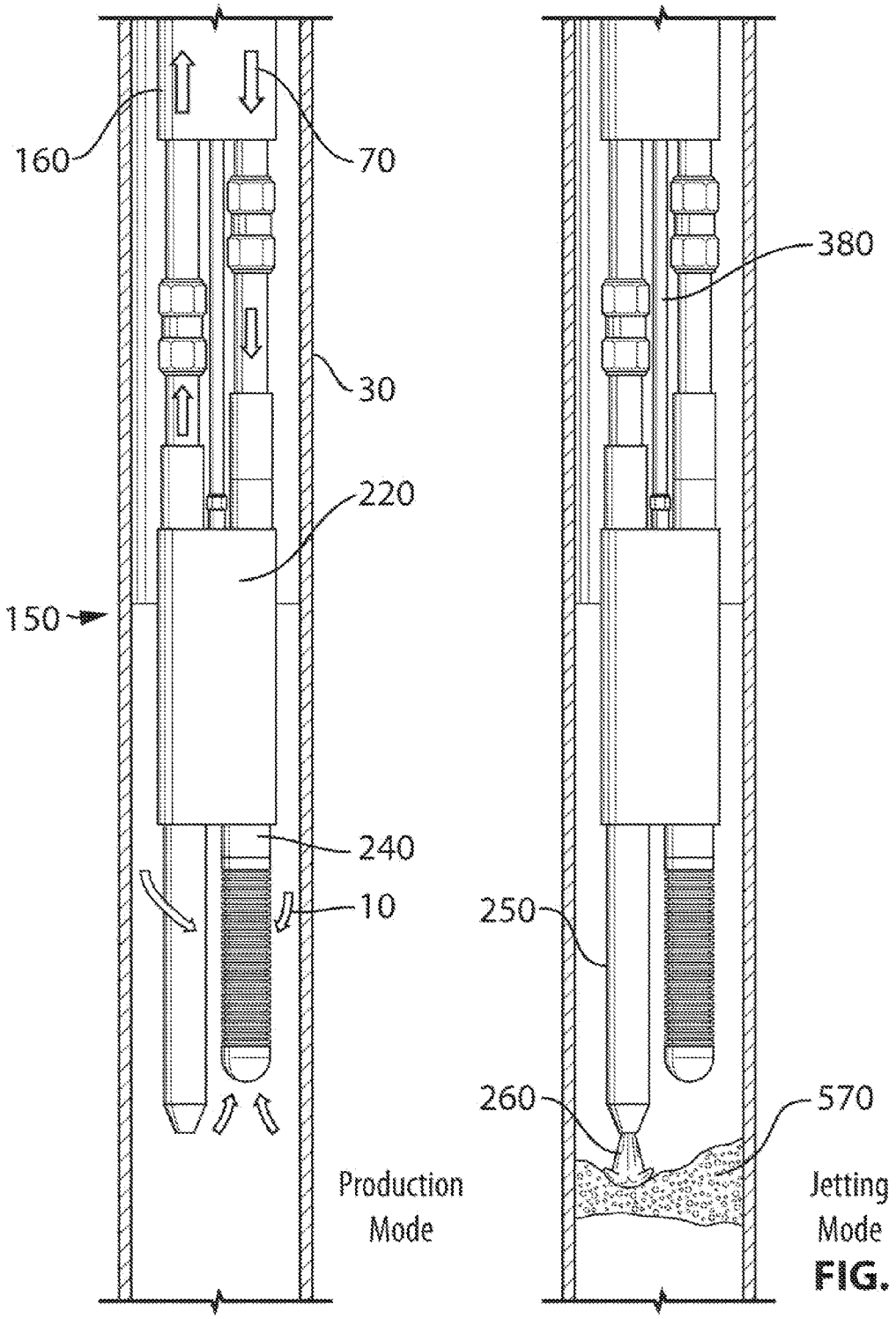
FIG. 19 depicts a method of the present invention of using one embodiment of a jet pump and spoolable multi-string tubing system to sequentially remove wellbore fluid and eliminate obstructions from a wellbore.

FIG. 19 illustrates a further embodiment of a method of using a jet pump 150. The jet pump 150 further includes an auxiliary tubing string 380 in fluid communication with the jetting sub 250, and may have a jet pump body 220 configured, for example, as in FIG. 10. Similarly to the method of FIG. 18, the jet pump 150 may be used in a production mode or a jetting mode. Changing from the production mode to the jetting mode may be accomplished by flowing jetting fluid 260 through the auxiliary tubing string 380, and reducing or removing fluid pressure from a supply tubing string 110. Changing from the jetting mode to the production mode may be accomplished by ceasing to flow jetting fluid 260 through the auxiliary tubing string 380 and supplying power fluid 70 to the supply tubing string 110 at a sufficient fluid pressure to generate suction at the jet pump intake 240.

Figure 20:
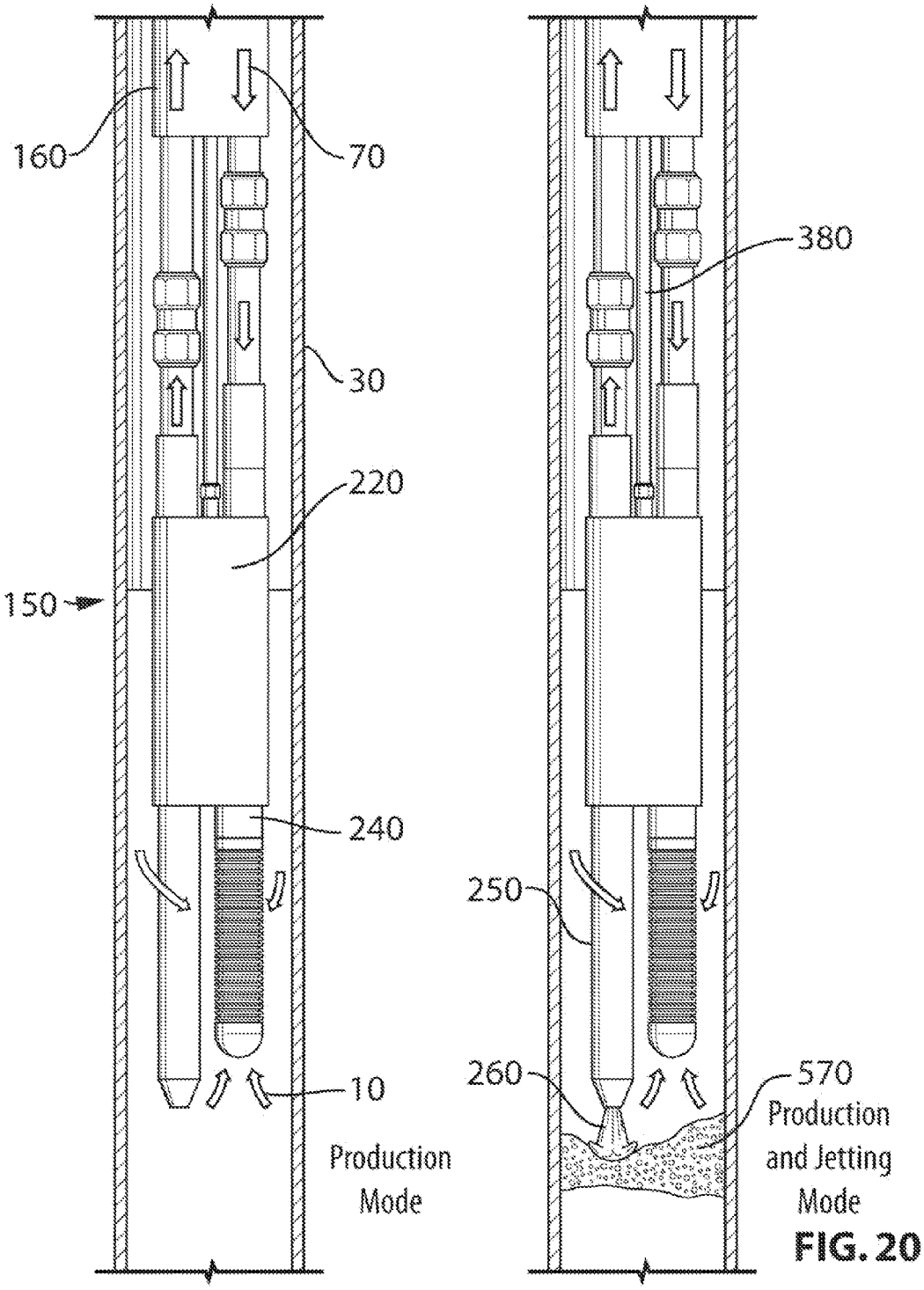
FIG. 20 depicts a method of the present invention of using the jet pump and spoolable multi-string tubing system of FIG. 19 to sequentially remove wellbore fluid, and simultaneously remove wellbore fluid and eliminate obstructions from a wellbore.

FIG. 20 illustrates a further embodiment of a method of using the jet pump 150 of FIG. 19. The jet pump 150 may be used in the production mode or in production and jetting mode. Changing from the production mode to jetting and production mode may be accomplished by flowing jetting fluid 260 through the auxiliary tubing string 380. Changing from the jetting mode to the production mode may be accomplished by ceasing to flow jetting fluid 260 through the auxiliary tubing string 380.

Figure 21:
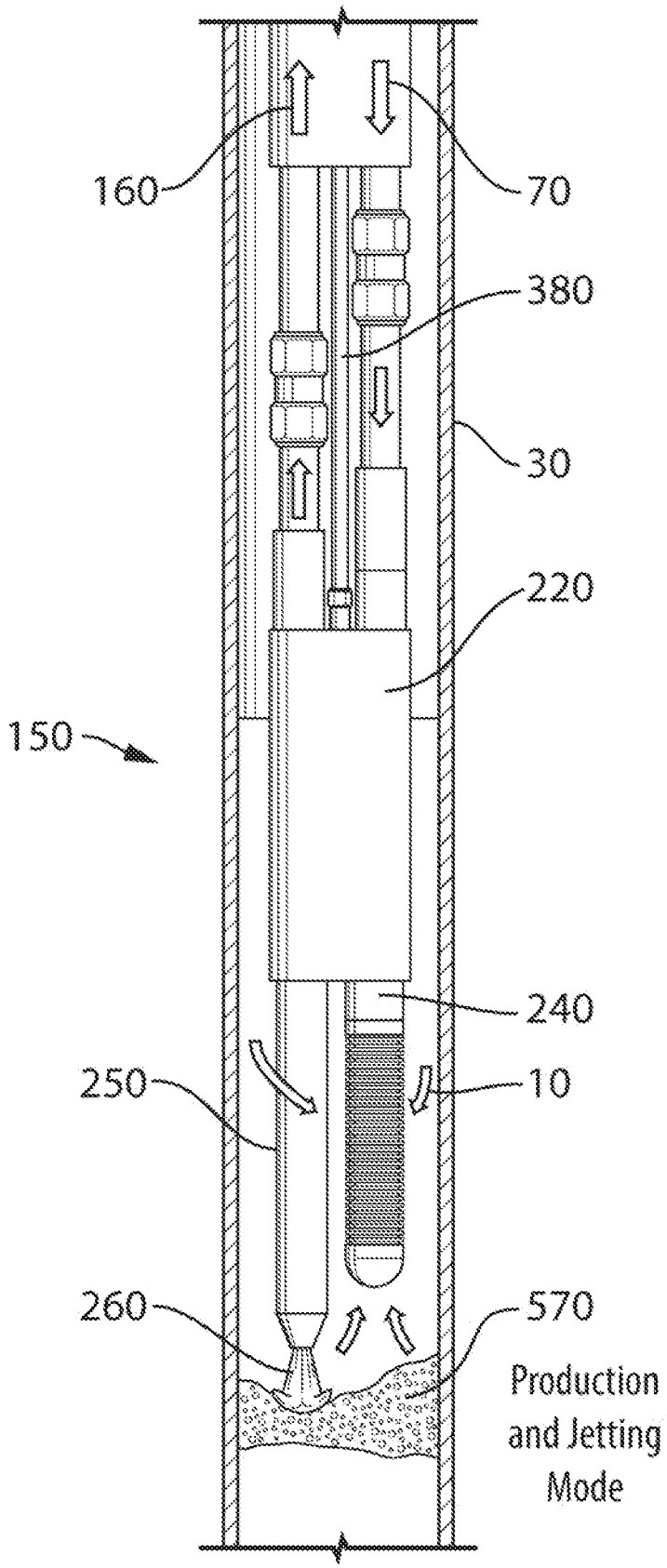
FIG. 21 depicts a method of the present invention of using the jet pump and spoolable multi-string tubing system of FIG. 19 to simultaneously remove wellbore fluid and eliminate obstructions from a wellbore.

FIG. 21 illustrates a further embodiment of a method of using the jet pump 150 of FIG. 19. Formation fluid 10 may be pumped to the surface by the jet pump 150 while jetting fluid 260 continuously flows from the jetting nozzle 270.

Permanent and Production SMTS

Figure 22:
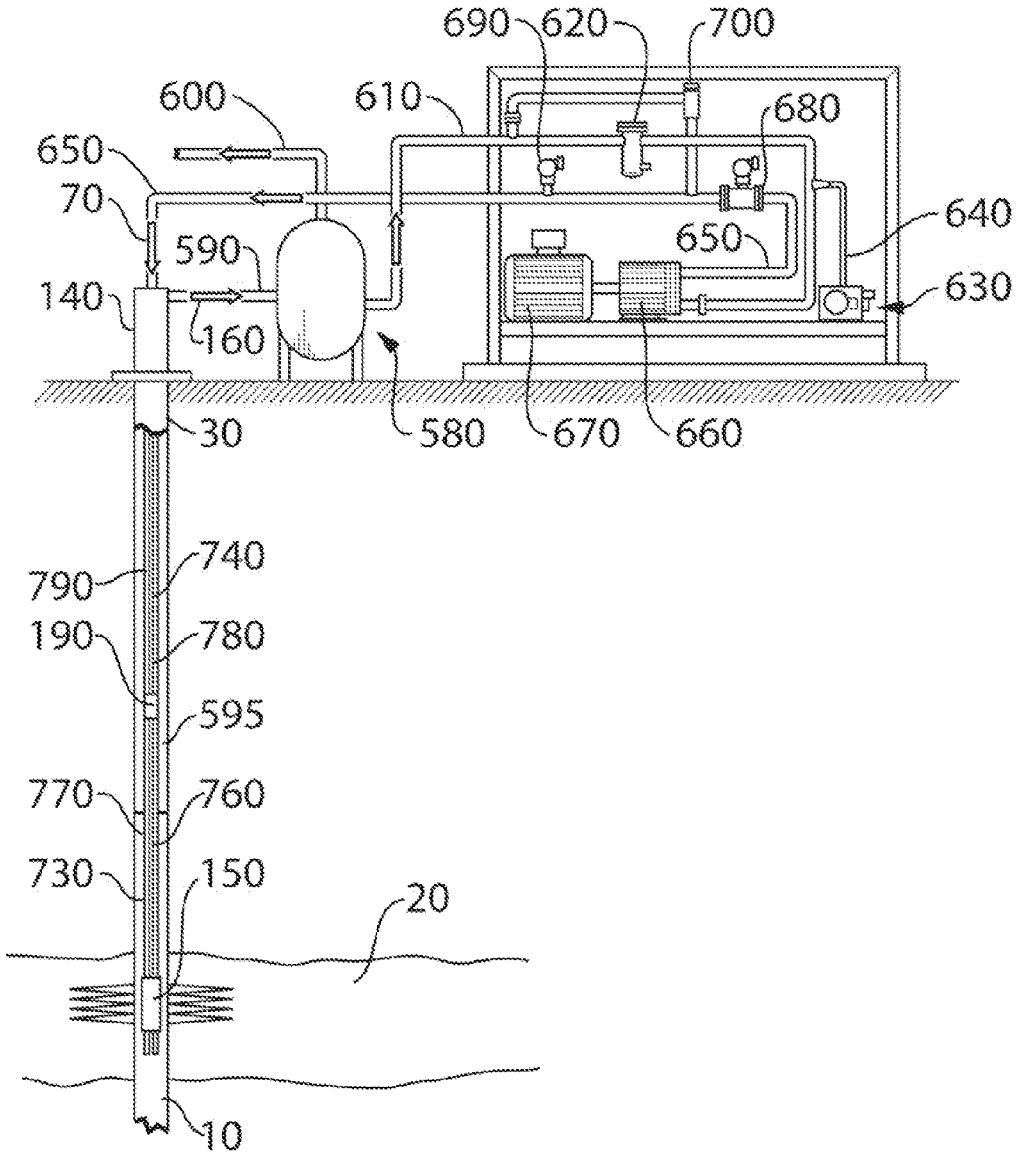
FIG. 22 is a schematic illustrating one embodiment of a fluid recovery system for producing formation fluid from a subsurface or subterranean hydrocarbon bearing formation of the present invention.

FIG. 22 depicts an embodiment of a fluid recovery system for producing formation fluid 10 from a subsurface or subterranean hydrocarbon bearing formation 20 via a wellbore 30. A jet pump 150 is run on the end of a permanent SMTS 730. The permanent SMTS 730 may include two or more conduits, for example a permanent supply tubing string 760 and a permanent return tubing string 770. A production SMTS 740 is hung off in a wellhead 140. The production SMTS 740 may include two or more conduits, for example a production supply tubing string 780 and a production return tubing string 790. The permanent SMTS 730 is in fluid communication with the production SMTS 740. The permanent SMTS 730 may be connected to the jet pump 150 and the production SMTS 740 may be connected to the injection line 650 and the surface flowline 590.

Figure 23:
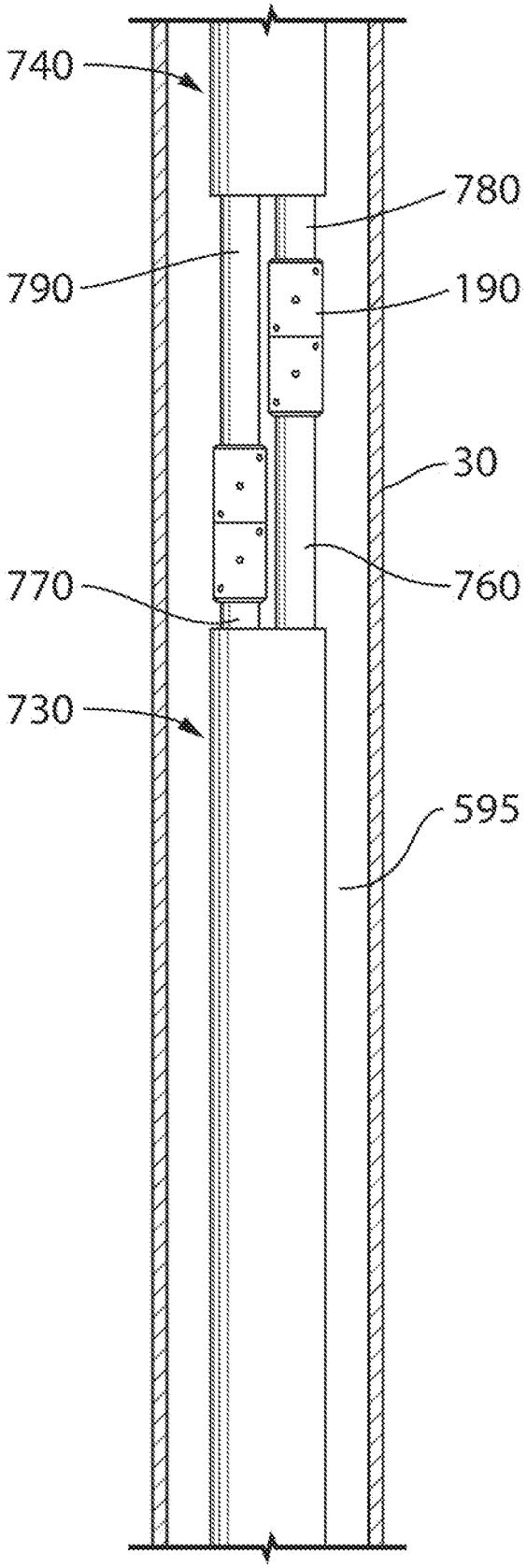
FIG. 23 is a production spoolable multi-string tubing system of the present invention attached to a permanent spoolable multi-string tubing system of the present invention.

FIG. 23 depicts a production SMTS 740 in fluid communication with a permanent SMTS 730. The production SMTS 740 is connected to the permanent SMTS 730 by connectors 190. Connectors 190 connect the permanent SMTS 730 with the production SMTS 740. When cleanout is desired, the production SMTS 740 may be disconnected from the permanent SMTS 730 and a cleanout SMTS 720 (FIG. 24) may be connected to the permanent SMTS 730. It is thus not necessary to remove the permanent SMTS 730 and the jet pump 150 to reconfigure the jet pump 150 from production to cleanout. While the permanent SMTS 730 and production SMTS 740 each have two conduits, analogous embodiments wherein, for example the permanent SMTS 730 includes a permanent auxiliary tubing string (not shown) or a permanent communications line (not shown), and the production SMTS 740 includes a production auxiliary tubing string (not shown) or a production communications line (not shown). All embodiments discussed above for methods of production may substitute a permanent SMTS 730 in fluid communication with a production SMTS 740 for a SMTS 100.

Cleanout System

Figure 24:
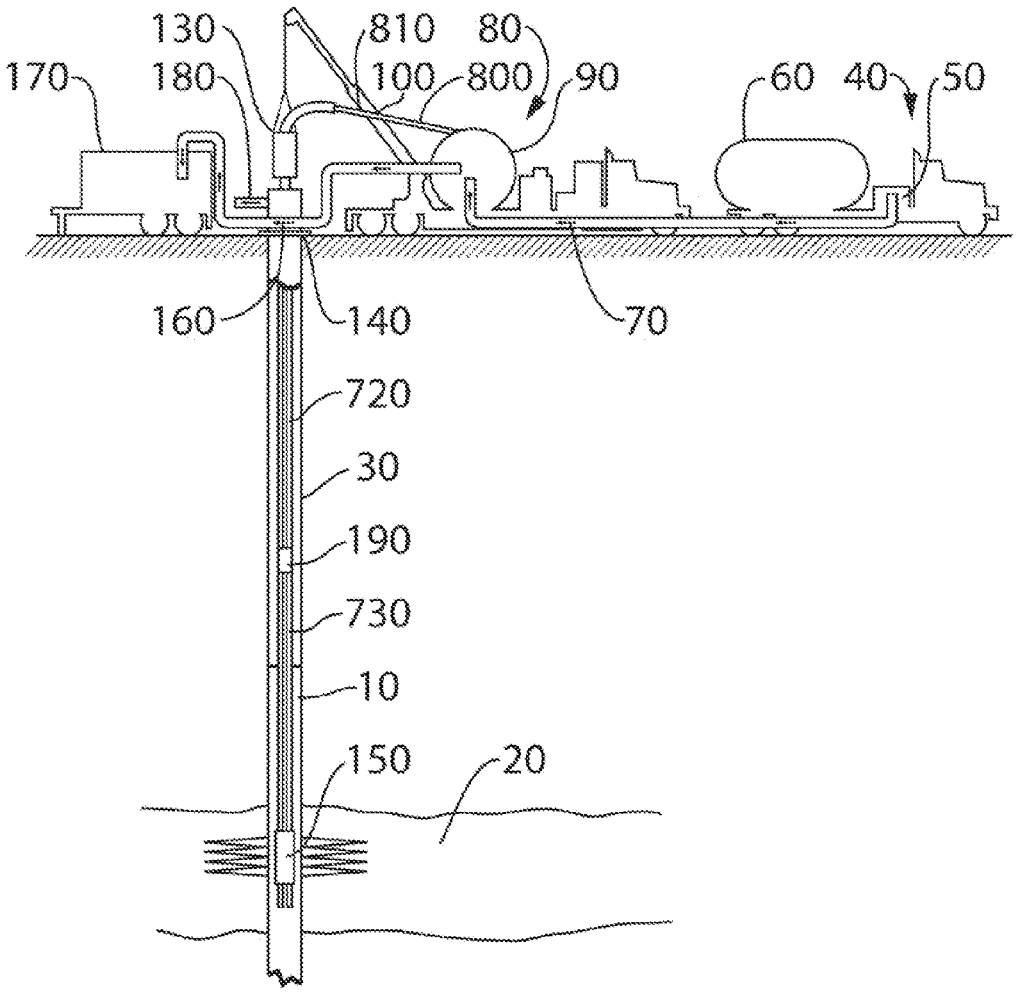
FIG. 24 is a schematic illustrating deployment of a jet pump and spoolable multi-string tubing system of the present invention for a cleanout operation.

FIG. 24 depicts a system including one embodiment of a multi-string tubing system and jet pump for removing wellbore fluid 710 from a subsurface or subterranean hydrocarbon bearing formation 20 via a wellbore 30. The wellbore fluid 710 may include entrained solids. A pressure pump truck 40 includes a surface pump 50 and a fluid storage tank 60. Power fluid 70 is conveyed to a coiled tubing unit 80. The power fluid 70 is typically either water- or hydrocarbon-based. The coiled tubing unit 80 includes a coiled tubing reel 90 with a cleanout SMTS 720. The cleanout SMTS 720 may include two or more conduits, for example a cleanout supply tubing string 800 and a cleanout return tubing string 810.

Power fluid 70 flows in a cleanout supply tubing string 800 of the cleanout SMTS 720. The cleanout SMTS 720 is deployed using a coiled tubing injector 130 with injector blocks adapted to run the cleanout SMTS 720. The cleanout SMTS 720 is positioned through a wellhead 140 and into the wellbore 30. The downhole end of the permanent SMTS 730 includes a jet pump 150 powered by power fluid 70, which is deployed into the wellbore 30 to remove wellbore fluid 710. Inside the jet pump 150, wellbore fluid 710 is combined with the power fluid 70; this combination is return fluid 160.

Return fluid 160 is pumped to the surface via the permanent return tubing string 770 and the cleanout return tubing string 810. The return fluid 160 exits the coiled tubing reel 90 and is conveyed to a return tank 170. Any gas from the wellbore 30 flows into a gas line 180. The gas line 180 may be shut in or opened to gas flow during use of the jet pump 150.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method of producing formation fluid from a hydrocarbon bearing formation comprising:

a. providing a spoolable multi-string tubing system having two or more conduits laterally disposed with respect to one another, the two or more conduits comprising a supply tubing string and a return tubing string;

b. providing a let pump having a power fluid inlet; a let pump intake, a venturi nozzle, a venturi gap, and a diffuser in fluid communication with the power fluid inlet; a return tube in fluid communication with the diffuser; and a return fluid outlet in fluid communication with the return tube; wherein the power fluid inlet and the return fluid outlet are laterally disposed with respect to one another to facilitate connection of the power fluid inlet to the supply tubing string and of the return fluid outlet to the return tubing string; and the jet pump further includes a jetting sub;

c. establishing fluid communication between the two or more conduits and the jet pump at the power fluid inlet and the return fluid outlet;

d. deploying the jet pump into a wellbore;

e. supplying power fluid to the jet pump via the supply tubing string;

f. receiving return fluid from the jet pump via the return tubing string; and g. flowing jetting fluid out of the jetting sub.

2. The method of claim 1 wherein flowing jetting fluid out of the jetting sub is continuously performed simultaneously with supplying power fluid to the jet pump and receiving return fluid from the jet pump.

3. The method of claim 1 wherein flowing jetting fluid out of the jetting sub is intermittently performed simultaneously with supplying power fluid to the jet pump and receiving return fluid from the jet pump.

4. The method of claim 1 wherein the spoolable multi-string tubing system further includes an auxiliary tubing string, and further comprising:

a. establishing fluid communication between the jet pump and the auxiliary tubing string; and b. supplying jetting fluid to the jetting sub via the auxiliary tubing string.

5. The method of claim 1 wherein the jet pump further includes a data-sensing sub, wherein the spoolable multi-string tubing system further includes a communications line, and further comprising:

a. operatively connecting the data-sensing sub and the communications line;

b. sensing data with the data-sensing sub; and c. receiving the data at the surface via the communications line.

6. The method of claim 1 wherein the venturi nozzle, venturi gap, and diffuser are located on a carrier sub, and further comprising:

a. ceasing to supply power fluid to the jet pump;

b. ceasing to receive return fluid from the jet pump; and c. supplying power fluid to the jet pump via the return tubing string to unseat the carrier sub and convey it to the surface via the supply tubing string.

7. The method of claim 6 further comprising supplying power fluid to the jet pump via the supply tubing string to convey the carrier sub to the jet pump and seat the carrier sub in the jet pump.

8. The method of claim 1 wherein the venturi nozzle and diffuser are substantially parallel with the return tube.

9. A method of producing formation fluid from a hydrocarbon bearing formation comprising:

a. providing a spoolable multi-string tubing system having two or more conduits laterally disposed with respect to one another, the two or more conduits comprising a supply tubing string and a return tubing string;

b. providing a let pump having a power fluid inlet; a let pump intake, a venturi nozzle, a venturi gap, and a diffuser in fluid communication with the power fluid inlet; a return tube in fluid communication with the diffuser; and a return fluid outlet in fluid communication with the return tube; wherein the power fluid inlet and the return fluid outlet are laterally disposed with respect to one another to facilitate connection of the power fluid inlet to the supply tubing string and of the return fluid outlet to the return tubing string; and the jet pump further includes a jetting sub;

c. establishing fluid communication between the two or more conduits and the jet pump at the power fluid inlet and the return fluid outlet;

d. deploying the jet pump into a wellbore;

e. supplying power fluid to the jet pump via the supply tubing string;

f. receiving return fluid from the jet pump via the return tubing string;

g. ceasing to receive return fluid from the jet pump;

h. flowing jetting fluid out of the jetting sub;

i. ceasing to flow jetting fluid out of the jetting sub; and j. receiving return fluid from the jet pump via the return tubing string.

10. A method of producing formation fluid from a hydrocarbon bearing formation comprising:

a. providing a spoolable multi-string tubing system having two or more conduits laterally disposed with respect to one another and an auxiliary tubing string, the two or more conduits comprising a supply tubing string and a return tubing string;

b. providing a let pump having a power fluid inlet; a let pump intake, a venturi nozzle, a venturi gap, and a diffuser in fluid communication with the power fluid inlet; a return tube in fluid communication with the diffuser; and a return fluid outlet in fluid communication with the return tube; wherein the power fluid inlet and the return fluid outlet are laterally disposed with respect to one another to facilitate connection of the power fluid inlet to the supply tubing string and of the return fluid outlet to the return tubing string; and the jet pump further includes a jetting sub;

c. establishing fluid communication between the two or more conduits and the jet pump at the power fluid inlet and the return fluid outlet, and between the jet pump and the auxiliary tubing string;

d. deploying the jet pump into a wellbore;

e. supplying power fluid to the jet pump via the supply tubing string;

f. receiving return fluid from the jet pump via the return tubing string;

g. ceasing to supply power fluid to the jet pump;

h. ceasing to receive return fluid from the jet pump;

i. supplying jetting fluid to the jetting sub via the auxiliary tubing string;

j. flowing jetting fluid out of the jetting sub;

k. ceasing to flow jetting fluid out of the jetting sub;

l. supplying power fluid to the jet pump; and m. receiving return fluid from the jet pump.

11. A method of producing formation fluids from a hydrocarbon bearing formation comprising:

a. providing a jet pump having a jet pump intake, a venturi nozzle, a venturi gap, and a diffuser;

b. providing a permanent spoolable multi-string tubing system having two or more conduits in fluid communication with the jet pump, the two or more conduits comprising a permanent supply tubing string and a permanent return tubing string;

c. providing a production spoolable multi-string tubing system having two or more conduits in fluid communication with the jet pump and with the permanent spoolable multi-string tubing system, the two or more conduits comprising a production supply tubing string and a production return tubing string;

d. deploying the jet pump into a wellbore;

e. supplying power fluid to the jet pump via the production supply tubing string and permanent supply tubing string; and f. receiving return fluid from the jet pump via the production return tubing string and permanent return tubing string.

12. The method of claim 11 further comprising:

a. providing a cleanout spoolable multi-string tubing system having two or more conduits, the two or more conduits comprising a cleanout supply tubing string and a cleanout return tubing string;

b. ceasing to supply power fluid to the jet pump;

c. ceasing to receive return fluid from the jet pump;

d. disconnecting the production spoolable multi-string tubing system from the permanent spoolable multi-string tubing system;

e. establishing fluid communication between the two or more conduits of the cleanout spoolable multi-string tubing system and the two or more conduits of the permanent spoolable multi-string tubing system;

f. supplying power fluid to the jet pump via the cleanout supply tubing string and permanent supply tubing string; and g. receiving return fluid from the jet pump via the cleanout return tubing string and permanent return tubing string.

13. The method of claim 11 wherein the jet pump further includes a jetting sub, and further comprising flowing jetting fluid out of the jetting sub.

14. The method of claim 13 wherein flowing jetting fluid out of the jetting sub is continuously performed simultaneously with supplying power fluid to the jet pump and receiving return fluid from the jet pump.

15. The method of claim 13 wherein flowing jetting fluid out of the jetting sub is intermittently performed simultaneously with supplying power fluid to the jet pump and receiving return fluid from the jet pump.

16. The method of claim 11 wherein the jet pump further includes a jetting sub, and further comprising:

a. ceasing to receive return fluid from the jet pump;
b. flowing jetting fluid out of the jetting sub;
c. ceasing to flow jetting fluid out of the jetting sub; and
d. receiving return fluid from the jet pump via the permanent return tubing string and production return tubing string.

17. The method of claim 11 wherein the jet pump further includes a jetting sub, wherein the permanent spoolable multi-string tubing system further includes a permanent auxiliary tubing string, wherein the production spoolable multi-string tubing system further includes a production auxiliary tubing string, and further comprising:

a. establishing fluid communication between the jet pump and the permanent auxiliary tubing string;
b. establishing fluid communication between the permanent auxiliary tubing string and the production tubing string;
c. supplying jetting fluid to the jetting sub via the production auxiliary tubing string and the permanent auxiliary tubing string; and
d. flowing jetting fluid out of the jetting sub.

18. The method of claim 11 wherein the jet pump further includes a jetting sub, wherein the permanent spoolable multi-string tubing system further includes a permanent auxiliary tubing string, wherein the production spoolable multi-string tubing system further includes a production auxiliary tubing string, and further comprising:

a. establishing fluid communication between the jet pump and the permanent auxiliary tubing string;
b. establishing fluid communication between the permanent auxiliary tubing string and the production tubing string;
c. ceasing to supply power fluid to the jet pump;
d. ceasing to receive return fluid from the jet pump;
e. supplying jetting fluid to the jetting sub via the production auxiliary tubing string and the permanent auxiliary tubing string;
f. flowing jetting fluid out of the jetting sub;
g. ceasing to flow jetting fluid out of the jetting sub;
h. supplying power fluid to the jet pump; and
i. receiving return fluid from the jet pump.

19. The method of claim 11 wherein the jet pump further includes a data-sensing sub, wherein the permanent spoolable multi-string tubing system further includes a permanent communications line, wherein the production spoolable multi-string tubing system further includes a production communications line, and further comprising:

a. operatively connecting the data-sensing sub and the permanent communications line;
b. operatively connecting the permanent communications line and the production communications line;
c. sensing data with the data-sensing sub; and
d. receiving the data at the surface via the communications line.

20. The method of claim 11 wherein the venturi nozzle, venturi gap, and diffuser are located on a carrier sub, and further comprising:

a. ceasing to supply power fluid to the jet pump;
b. ceasing to receive return fluid from the jet pump;
c. supplying power fluid to the jet pump via the production return tubing string and permanent return tubing string to unseat the carrier sub and convey it to the surface via the production supply tubing string and permanent supply tubing string.

21. The method of claim 20 further comprising supplying power fluid to the jet pump via the production supply tubing string and permanent supply tubing string to convey the carrier sub to the jet pump and seat the carrier sub in the jet pump.

22. A method of producing formation fluid from a hydrocarbon bearing formation comprising:

a. providing a spoolable multi-string tubing system having two or more conduits and an auxiliary tubing string, the two or more conduits comprising a supply tubing string and a return tubing string;
b. providing a jet pump having a jet pump intake, a venturi nozzle, a venturi gap, a diffuser, a jetting sub;
c. establishing fluid communication between the two or more conduits and the jet pump, and between the auxiliary tubing string and the jet pump;
d. deploying the jet pump into a wellbore;
e. supplying power fluid to the jet pump via the supply tubing string;
f. receiving return fluid from the jet pump via the return tubing string;
g. supplying jetting fluid to the jetting sub via the auxiliary tubing string; and
h. flowing jetting fluid out of the jetting sub.

23. A method of producing formation fluid from a hydrocarbon bearing formation comprising:

a. providing a spoolable multi-string tubing system having two or more conduits and an auxiliary tubing string, the two or more conduits comprising a supply tubing string and a return tubing string;
b. providing a jet pump having a jet pump intake, a venturi nozzle, a venturi gap, a diffuser, a jetting sub;
c. establishing fluid communication between the two or more conduits and the jet pump, and between the auxiliary tubing string and the jet pump;
d. deploying the jet pump into a wellbore;
e. supplying power fluid to the jet pump via the supply tubing string;
f. receiving return fluid from the jet pump via the return tubing string;
g. ceasing to supply power fluid to the jet pump;
h. ceasing to receive return fluid from the jet pump;
i. supplying jetting fluid to the jetting sub via the auxiliary tubing string;
j. flowing jetting fluid out of the jetting sub;
k. ceasing to flow jetting fluid out of the jetting sub;
l. supplying power fluid to the jet pump; and
m. receiving return fluid from the jet pump.

24. A system for producing formation fluids from a hydrocarbon bearing formation comprising:

a. a jet pump having a jet pump intake, a venturi nozzle, a venturi gap, and a diffuser;
b. a permanent spoolable multi-string tubing system having two or more conduits for establishing fluid communication with the jet pump, the two or more conduits comprising a permanent supply tubing string and a permanent return tubing string; and
c. a production spoolable multi-string tubing system having two or more conduits for establishing fluid communication with the jet pump and with the permanent spoolable multi-string tubing system, the two or more conduits comprising a production supply tubing string and a production return tubing string.

25. The system of claim 24 further comprising a cleanout spoolable multi-string tubing system having two or more conduits, the two or more conduits comprising a cleanout supply tubing string and a cleanout return tubing string, for establishing fluid communication between the two or more conduits of the cleanout spoolable multi-string tubing system and the two or more conduits of the permanent spoolable multi-string tubing system.

26. The system of claim 24 wherein the jet pump further includes a jetting sub for flowing jetting fluid out of.

27. The system of claim 24 wherein:

a. the jet pump further includes a jetting sub for flowing jetting fluid out of;

b. the permanent spoolable multi-string tubing system further includes a permanent auxiliary tubing string for establishing fluid communication with the jet pump for supplying jetting fluid to the jetting sub; and c. the production spoolable multi-string tubing system further includes a production auxiliary tubing string for establishing fluid communication with the jet pump and with the permanent auxiliary tubing string.

28. The system of claim 24 wherein:

a. the jet pump further includes a data-sensing sub;

b. the permanent spoolable multi-string tubing system further includes a permanent communications line for operatively connecting to the data-sensing sub; and c. the production spoolable multi-string tubing system further includes a production communications line for operatively connecting to the permanent communications line.

29. The system of claim 24 wherein the venturi nozzle, venturi gap, and diffuser are located on a carrier sub for unseating and conveying to the surface via the production supply tubing string and permanent supply tubing string returning to the surface when power fluid is supplied to the jet pump via the production return tubing string and permanent return tubing string.

30. A method of producing formation fluid from a hydrocarbon bearing formation comprising:

a. providing a spoolable multi-string tubing system having two or more conduits laterally disposed with respect to one another, the two or more conduits comprising a supply tubing string and a return tubing string;

b. providing a jet pump having a power fluid inlet; a jet pump intake, a venturi nozzle, a venturi gap, and a diffuser in fluid communication with the power fluid inlet; a return tube in fluid communication with the diffuser; and a return fluid outlet in fluid communication with the return tube; wherein the power fluid inlet and the return fluid outlet are laterally disposed with respect to one another to facilitate connection of the power fluid inlet to the supply tubing string and of the return fluid outlet to the return tubing string; and the venturi nozzle, venturi gap, and diffuser are located on a carrier sub;

c. establishing fluid communication between the two or more conduits and the jet pump at the power fluid inlet and the return fluid outlet;

d. deploying the jet pump into a wellbore;

e. supplying power fluid to the jet pump via the supply tubing string;

f. receiving return fluid from the jet pump via the return tubing string;

g. ceasing to supply power fluid to the jet pump;

h. ceasing to receive return fluid from the jet pump; and i. supplying power fluid to the jet pump via the return tubing string to unseat the carrier sub and convey it to the surface via the supply tubing string.

31. The method of claim 30 further comprising supplying power fluid to the jet pump via the supply tubing string to convey the carrier sub to the jet pump and seat the carrier sub in the jet pump.

* * * * *